US010391489B2

(12) United States Patent
Wright et al.

(10) Patent No.: US 10,391,489 B2
(45) **Date of Patent: *Aug. 27, 2019**

(54) APPARATUS AND METHODS FOR MANIPULATING DEFORMABLE FLUID VESSELS

(71) Applicant: GENMARK DIAGNOSTICS, INC., Carlsbad, CA (US)

(72) Inventors: David Walter Wright, Littleton, CO (US); Dominic Aiello, Denver, CO (US); Robert Clark, Centennial, OH (US)

(73) Assignee: GenMark Diagnostics, Inc., Carlsbad, CA (US)

( * ) Notice: Subject to any disclaimer, the term of this patent is extended or adjusted under 35 U.S.C. 154(b) by 25 days.

This patent is subject to a terminal disclaimer.

(21) Appl. No.: 15/184,281

(22) Filed: Jun. 16, 2016

(65) Prior Publication Data

US 2016/0297570 A1 Oct. 13, 2016

Related U.S. Application Data

(63) Continuation of application No. 14/206,817, filed on Mar. 12, 2014, now Pat. No. 9,410,663.
(Continued)

(51) Int. Cl.
*F17D 1/08* (2006.01)
*B01L 3/00* (2006.01)
(Continued)

(52) U.S. Cl.
CPC ..... *B01L 3/50273* (2013.01); *B01L 3/502* (2013.01); *B01L 3/505* (2013.01);
(Continued)

(58) Field of Classification Search
None
See application file for complete search history.

(56) References Cited

U.S. PATENT DOCUMENTS

D60,340 S 2/1922 Grier
D202,013 S 8/1965 Hamilton
(Continued)

FOREIGN PATENT DOCUMENTS

CN 101715428 A 5/2010
EP 0173547 B1 6/1990
(Continued)

OTHER PUBLICATIONS

Australian Examination Report No. 2 dated Feb. 9, 2018 issued in Australian Patent Application No. 2014235532; 3 pages.
(Continued)

*Primary Examiner* — Kathryn Wright
(74) *Attorney, Agent, or Firm* — Brinks Gilson & Lione

(57) ABSTRACT

An apparatus for processing a fluid module, including a collapsible vessel supported on a planar substrate, comprises a first actuator component configured to be movable in a first direction is generally parallel to the plane of the substrate, a second actuator component configured to be movable in a second direction having a component that is normal to the plane of the substrate, and a motion conversion mechanism coupling the first actuator component with the second actuator component and configured to convert movement of the first actuator component in the first direction into movement of the second actuator component in the second direction.

12 Claims, 17 Drawing Sheets

Related U.S. Application Data

(60) Provisional application No. 61/798,091, filed on Mar. 15, 2013.

(51) Int. Cl.

| | |
|---|---|
| ***B65D 83/00*** | (2006.01) |
| ***B65D 35/30*** | (2006.01) |
| ***B65D 35/56*** | (2006.01) |
| ***B65D 35/28*** | (2006.01) |

(52) U.S. Cl.

CPC ..... *B01L 3/502715* (2013.01); *B01L 3/523* (2013.01); *B65D 35/28* (2013.01); *B65D 35/30* (2013.01); *B65D 35/56* (2013.01); *B65D 83/0055* (2013.01); *F17D 1/08* (2013.01); *B01L 2200/0689* (2013.01); *B01L 2200/16* (2013.01); *B01L 2300/044* (2013.01); *B01L 2300/0672* (2013.01); *B01L 2300/087* (2013.01); *B01L 2300/0816* (2013.01); *B01L 2300/0861* (2013.01); *B01L 2300/123* (2013.01); *B01L 2400/0481* (2013.01); *B01L 2400/0683* (2013.01); *Y10T 137/0318* (2015.04); *Y10T 137/87917* (2015.04)

(56) References Cited

U.S. PATENT DOCUMENTS

| | | | |
|---|---|---|---|
| 3,641,909 | A | 2/1972 | Baker |
| 3,687,051 | A | 8/1972 | Baker et al. |
| 3,776,425 | A | 12/1973 | Baker et al. |
| 3,820,149 | A | 6/1974 | Baker et al. |
| D234,404 | S | 2/1975 | Merrill |
| 4,007,010 | A | 2/1977 | Woodbridge, III |
| 4,065,263 | A | 12/1977 | Woodbridge, III |
| D253,126 | S | 10/1979 | Baxter |
| 4,182,447 | A | 1/1980 | Kay |
| D268,130 | S | 3/1983 | Easton |
| 4,429,792 | A | 2/1984 | Machbitz |
| 4,469,863 | A | 9/1984 | Ts'o et al. |
| 4,526,320 | A | 7/1985 | Von Philipp et al. |
| D287,760 | S | 1/1987 | Discko, Jr. |
| 4,739,903 | A | 4/1988 | Bedwell et al. |
| 4,769,333 | A | 9/1988 | Dole et al. |
| 4,844,251 | A | 7/1989 | Gueret |
| 4,859,603 | A | 8/1989 | Dole et al. |
| 4,887,455 | A | 12/1989 | Payne et al. |
| 4,978,502 | A | 12/1990 | Dole et al. |
| 5,034,506 | A | 7/1991 | Summerton et al. |
| 5,089,233 | A | 2/1992 | Devaney, Jr. |
| 5,098,660 | A | 3/1992 | Devaney, Jr. |
| D327,363 | S | 6/1992 | Farb |
| 5,154,888 | A | 10/1992 | Zander et al. |
| 5,216,141 | A | 6/1993 | Benner |
| 5,229,297 | A | 7/1993 | Schnipelsky et al. |
| 5,234,809 | A | 8/1993 | Boom et al. |
| 5,235,033 | A | 8/1993 | Summerton et al. |
| 5,254,479 | A | 10/1993 | Chemelli |
| 5,288,463 | A | 2/1994 | Chemelli |
| 5,290,518 | A | 3/1994 | Johnson |
| D350,478 | S | 9/1994 | Fuller |
| D351,996 | S | 11/1994 | Kalvelage |
| 5,374,395 | A | 12/1994 | Robinson et al. |
| 5,386,023 | A | 1/1995 | Sanghvi et al. |
| 5,422,271 | A | 6/1995 | Chen et al. |
| 5,460,780 | A | 10/1995 | Devaney, Jr. |
| 5,468,366 | A | 11/1995 | Wegner et al. |
| 5,512,439 | A | 4/1996 | Hornes et al. |
| 5,529,188 | A | 6/1996 | Coggswell |
| 5,591,578 | A | 1/1997 | Meade et al. |
| 5,593,804 | A | 1/1997 | Chemelli et al. |
| 5,602,240 | A | 2/1997 | De Mesmaeker et al. |
| 5,637,684 | A | 6/1997 | Cook et al. |
| 5,644,048 | A | 7/1997 | Yau |
| 5,652,149 | A | 7/1997 | Mileaf et al. |
| 5,674,653 | A | 10/1997 | Chemelli et al. |
| 5,681,702 | A | 10/1997 | Collins et al. |
| 5,692,644 | A | 12/1997 | Gueret |
| 5,705,348 | A | 1/1998 | Meade et al. |
| 5,705,628 | A | 1/1998 | Hawkins |
| 5,714,380 | A | 2/1998 | Neri et al. |
| 5,716,852 | A | 2/1998 | Yager et al. |
| 5,726,404 | A | 3/1998 | Brody |
| 5,726,751 | A | 3/1998 | Altendorf et al. |
| 5,747,349 | A | 5/1998 | Van Den Engh et al. |
| 5,748,827 | A | 5/1998 | Holl et al. |
| 5,770,365 | A | 6/1998 | Lane et al. |
| 5,807,701 | A | 9/1998 | Payne et al. |
| 5,824,473 | A | 10/1998 | Meade et al. |
| 5,842,787 | A | 12/1998 | Kopf-Sill et al. |
| 5,849,486 | A | 12/1998 | Heller et al. |
| 5,851,536 | A | 12/1998 | Yager et al. |
| 5,873,990 | A | 2/1999 | Wojciechowski et al. |
| 5,876,187 | A | 3/1999 | Afromowitz et al. |
| 5,882,497 | A | 3/1999 | Persaud et al. |
| 5,898,071 | A | 4/1999 | Hawkins |
| 5,932,100 | A | 8/1999 | Yager et al. |
| 5,948,684 | A | 9/1999 | Weigl et al. |
| 5,955,028 | A | 9/1999 | Chow |
| 5,957,579 | A | 9/1999 | Kopf-Sill et al. |
| 5,971,158 | A | 10/1999 | Yager et al. |
| 5,972,710 | A | 10/1999 | Weigl et al. |
| 5,973,138 | A | 10/1999 | Collis |
| 5,974,867 | A | 11/1999 | Forster et al. |
| 6,003,728 | A | 12/1999 | Elliott |
| 6,007,775 | A | 12/1999 | Yager |
| 6,013,170 | A | 1/2000 | Meade |
| 6,013,459 | A | 1/2000 | Meade |
| 6,033,601 | A | 3/2000 | Persaud et al. |
| 6,039,897 | A | 3/2000 | Lochhead et al. |
| 6,063,573 | A | 5/2000 | Kayyem |
| 6,065,641 | A | 5/2000 | Laguna Valderrama |
| 6,067,157 | A | 5/2000 | Altendorf |
| 6,071,478 | A | 6/2000 | Chow |
| 6,090,933 | A | 7/2000 | Kayyem et al. |
| 6,091,502 | A | 7/2000 | Weigl et al. |
| 6,096,273 | A | 8/2000 | Kayyem et al. |
| 6,098,795 | A | 8/2000 | Mollstam et al. |
| 6,110,354 | A | 8/2000 | Saban et al. |
| 6,123,798 | A | 9/2000 | Gandhi et al. |
| 6,134,950 | A | 10/2000 | Forster et al. |
| 6,136,272 | A | 10/2000 | Weigl et al. |
| 6,159,739 | A | 12/2000 | Weigl et al. |
| 6,167,910 | B1 | 1/2001 | Chow |
| 6,171,865 | B1 | 1/2001 | Weigl et al. |
| 6,180,064 | B1 | 1/2001 | Persaud et al. |
| 6,180,114 | B1 | 1/2001 | Yager et al. |
| 6,190,858 | B1 | 2/2001 | Persaud et al. |
| 6,192,351 | B1 | 2/2001 | Persaud |
| 6,221,583 | B1 | 4/2001 | Kayyem et al. |
| 6,221,677 | B1 | 4/2001 | Wu et al. |
| 6,227,809 | B1 | 5/2001 | Forster et al. |
| 6,230,884 | B1 | 5/2001 | Coory |
| 6,232,062 | B1 | 5/2001 | Kayyem et al. |
| 6,235,501 | B1 | 5/2001 | Gautsch et al. |
| 6,236,951 | B1 | 5/2001 | Payne et al. |
| 6,248,229 | B1 | 6/2001 | Meade |
| 6,255,477 | B1 | 7/2001 | Kleiber et al. |
| 6,264,825 | B1 | 7/2001 | Blackburn et al. |
| 6,265,155 | B1 | 7/2001 | Meade et al. |
| 6,268,136 | B1 | 7/2001 | Shuber et al. |
| 6,277,641 | B1 | 8/2001 | Yager |
| 6,290,839 | B1 | 9/2001 | Kayyem et al. |
| 6,297,061 | B1 | 10/2001 | Wu et al. |
| 6,300,138 | B1 | 10/2001 | Gleason et al. |
| 6,321,791 | B1 | 11/2001 | Chow |
| 6,361,958 | B1 | 3/2002 | Shieh et al. |
| 6,366,924 | B1 | 4/2002 | Parce |
| 6,376,232 | B1 | 4/2002 | Payne et al. |
| 6,387,290 | B1 | 5/2002 | Brody et al. |
| 6,391,558 | B1 | 5/2002 | Henkens et al. |
| 6,391,622 | B1 | 5/2002 | Knapp et al. |
| 6,399,023 | B1 | 6/2002 | Chow |
| 6,399,025 | B1 | 6/2002 | Chow |

(56) References Cited

U.S. PATENT DOCUMENTS

| | | | |
|---|---|---|---|
| 6,403,338 | B1 | 6/2002 | Knapp et al. |
| 6,404,493 | B1 | 6/2002 | Altendorf |
| 6,406,857 | B1 | 6/2002 | Shuber et al. |
| 6,408,884 | B1 | 6/2002 | Kamholz et al. |
| 6,409,832 | B2 | 6/2002 | Wiegl et al. |
| 6,415,821 | B2 | 7/2002 | Kamholz et al. |
| 6,426,230 | B1 | 7/2002 | Feistel |
| 6,431,016 | B1 | 8/2002 | Payne |
| 6,431,212 | B1 | 8/2002 | Hayenga et al. |
| 6,431,476 | B1 | 8/2002 | Taylor et al. |
| 6,432,720 | B2 | 8/2002 | Chow |
| 6,432,723 | B1 | 8/2002 | Plaxco et al. |
| 6,433,160 | B1 | 8/2002 | Collis |
| 6,440,725 | B1 | 8/2002 | Pourahmadi et al. |
| 6,443,307 | B1 | 9/2002 | Burridge |
| 6,451,606 | B1 | 9/2002 | König et al. |
| 6,454,945 | B1 | 9/2002 | Weigl et al. |
| 6,479,240 | B1 | 11/2002 | Kayyem et al. |
| 6,482,306 | B1 | 11/2002 | Yager et al. |
| 6,488,895 | B1 | 12/2002 | Kennedy |
| 6,488,896 | B2 | 12/2002 | Weigl et al. |
| 6,494,230 | B2 | 12/2002 | Chow |
| 6,495,104 | B1 | 12/2002 | Unno et al. |
| 6,495,323 | B1 | 12/2002 | Kayyem et al. |
| 6,503,757 | B1 | 1/2003 | Chow |
| 6,518,024 | B2 | 2/2003 | Choong et al. |
| 6,524,456 | B1 | 2/2003 | Ramsey et al. |
| 6,537,501 | B1 | 3/2003 | Holl et al. |
| 6,541,213 | B1 | 4/2003 | Weigl et al. |
| 6,541,617 | B1 | 4/2003 | Bamdad et al. |
| 6,557,427 | B2 | 5/2003 | Weigl et al. |
| 6,562,568 | B1 | 5/2003 | Kleiber et al. |
| 6,565,727 | B1 | 5/2003 | Shenderov |
| 6,575,188 | B2 | 6/2003 | Parunak |
| 6,576,194 | B1 | 6/2003 | Holl et al. |
| 6,581,899 | B2 | 6/2003 | Williams |
| 6,582,963 | B1 | 6/2003 | Weigl et al. |
| 6,596,483 | B1 | 7/2003 | Choong et al. |
| 6,600,026 | B1 | 7/2003 | Yu |
| 6,602,400 | B1 | 8/2003 | Choong et al. |
| 6,627,412 | B1 | 9/2003 | Manning et al. |
| 6,642,046 | B1 | 11/2003 | McGarry et al. |
| 6,645,758 | B1 | 11/2003 | Schnipelsky et al. |
| 6,647,397 | B2 | 11/2003 | Parce |
| 6,648,015 | B1 | 11/2003 | Chow |
| 6,655,010 | B1 | 12/2003 | Hatfield et al. |
| 6,656,431 | B2 | 12/2003 | Holl et al. |
| 6,660,480 | B2 | 12/2003 | Ramsey et al. |
| 6,664,104 | B2 | 12/2003 | Pourahmadi et al. |
| 6,674,525 | B2 | 1/2004 | Bardell et al. |
| 6,686,150 | B1 | 2/2004 | Blackburn et al. |
| 6,695,147 | B1 | 2/2004 | Yager et al. |
| 6,706,498 | B2 | 3/2004 | Gautsch et al. |
| 6,712,925 | B1 | 3/2004 | Holl et al. |
| 6,739,531 | B2 | 5/2004 | Taylor |
| 6,740,518 | B1 | 5/2004 | Duong et al. |
| 6,742,661 | B1 | 6/2004 | Schulte et al. |
| 6,743,399 | B1 | 6/2004 | Weigl et al. |
| 6,753,143 | B2 | 6/2004 | Tao et al. |
| 6,761,816 | B1 | 7/2004 | Blackburn et al. |
| 6,773,566 | B2 | 8/2004 | Shenderov |
| 6,783,647 | B2 | 8/2004 | Culbertson et al. |
| 6,790,341 | B1 | 9/2004 | Saban et al. |
| 6,811,668 | B1 | 11/2004 | Berndt et al. |
| 6,824,669 | B1 | 11/2004 | Li et al. |
| 6,830,729 | B1 | 12/2004 | Holl et al. |
| 6,833,267 | B1 | 12/2004 | Kayyem |
| 6,852,284 | B1 | 2/2005 | Holl et al. |
| 6,857,449 | B1 | 2/2005 | Chow |
| 6,875,619 | B2 | 4/2005 | Blackburn |
| 6,878,540 | B2 | 4/2005 | Pourahmadi et al. |
| 6,881,312 | B2 | 4/2005 | Kopf-Sill et al. |
| 6,881,541 | B2 | 4/2005 | Petersen et al. |
| 6,887,693 | B2 | 5/2005 | McMillan et al. |
| 6,893,879 | B2 | 5/2005 | Petersen et al. |
| 6,914,137 | B2 | 7/2005 | Baker |
| 6,919,444 | B2 | 7/2005 | Harttig et al. |
| 6,942,771 | B1 | 9/2005 | Kayyem |
| 6,951,759 | B2 | 10/2005 | Travers et al. |
| 6,960,437 | B2 | 11/2005 | Enzelberger et al. |
| 6,960,467 | B2 | 11/2005 | Shieh et al. |
| 6,967,489 | B2 | 11/2005 | Brooks et al. |
| 6,968,978 | B1 | 11/2005 | Matthews |
| 6,977,151 | B2 | 12/2005 | Kayyem et al. |
| 6,979,424 | B2 | 12/2005 | Northrup et al. |
| 7,010,391 | B2 | 3/2006 | Handique et al. |
| 7,011,791 | B2 | 3/2006 | Weigl et al. |
| 7,014,992 | B1 | 3/2006 | Kayyem et al. |
| 7,018,523 | B2 | 3/2006 | Meade |
| 7,030,989 | B2 | 4/2006 | Yager et al. |
| 7,045,285 | B1 | 5/2006 | Kayyem et al. |
| 7,056,475 | B2 | 6/2006 | Lum et al. |
| 7,056,669 | B2 | 6/2006 | Kayyem et al. |
| 7,087,148 | B1 | 8/2006 | Blackburn et al. |
| 7,090,804 | B2 | 8/2006 | Kayyem et al. |
| 7,119,194 | B2 | 10/2006 | Uematsu et al. |
| 7,125,668 | B2 | 10/2006 | Kayyem et al. |
| 7,141,429 | B2 | 11/2006 | Munson et al. |
| 7,155,344 | B1 | 12/2006 | Parce et al. |
| 7,160,678 | B1 | 1/2007 | Kayyem et al. |
| 7,163,612 | B2 | 1/2007 | Sterling et al. |
| 7,169,358 | B2 | 1/2007 | Henkens et al. |
| 7,172,897 | B2 | 2/2007 | Blackburn et al. |
| 7,192,557 | B2 | 3/2007 | Wu et al. |
| 7,201,881 | B2 | 4/2007 | Cox |
| 7,208,271 | B2 | 4/2007 | Bost et al. |
| 7,223,371 | B2 | 5/2007 | Hayenga et al. |
| 7,226,562 | B2 | 6/2007 | Holl et al. |
| 7,238,268 | B2 | 7/2007 | Ramsey et al. |
| 7,255,780 | B2 | 8/2007 | Shenderov |
| 7,258,837 | B2 | 8/2007 | Yager et al. |
| 7,267,939 | B2 | 9/2007 | Meade |
| 7,270,786 | B2 | 9/2007 | Parunak et al. |
| 7,271,007 | B2 | 9/2007 | Weigl et al. |
| 7,312,087 | B2 | 12/2007 | Duong et al. |
| 7,323,140 | B2 | 1/2008 | Handique et al. |
| 7,343,248 | B2 | 3/2008 | Parce et al. |
| 7,364,886 | B2 | 4/2008 | Hasenbank et al. |
| 7,371,830 | B2 | 5/2008 | Kleiber et al. |
| 7,381,525 | B1 | 6/2008 | Kayyem et al. |
| 7,381,533 | B2 | 6/2008 | Kayyem et al. |
| 7,384,749 | B2 | 6/2008 | Kayyem et al. |
| 7,393,645 | B2 | 7/2008 | Kayyem et al. |
| 7,405,054 | B1 | 7/2008 | Hasenbank et al. |
| 7,416,791 | B1 | 8/2008 | Carlson et al. |
| 7,416,892 | B2 | 8/2008 | Battrell et al. |
| 7,419,575 | B2 | 9/2008 | Culbertson et al. |
| 7,419,638 | B2 | 9/2008 | Saltsman et al. |
| 7,439,014 | B2 | 10/2008 | Pamula et al. |
| 7,449,096 | B2 | 11/2008 | Berndt et al. |
| 7,473,397 | B2 | 1/2009 | Griffin et al. |
| 7,491,495 | B2 | 2/2009 | Zielenski et al. |
| 7,497,997 | B2 | 3/2009 | Glezer et al. |
| 7,514,228 | B2 | 4/2009 | Meade |
| 7,534,331 | B2 | 5/2009 | Kayyem |
| 7,544,506 | B2 | 6/2009 | Breidford et al. |
| 7,550,267 | B2 | 6/2009 | Hawkins et al. |
| 7,560,237 | B2 | 7/2009 | O'Connor et al. |
| 7,566,534 | B2 | 7/2009 | Meade |
| 7,569,346 | B2 | 8/2009 | Petersen et al. |
| 7,579,145 | B2 | 8/2009 | Meade |
| D599,832 | S | 9/2009 | Chapin et al. |
| D600,503 | S | 9/2009 | Ragsdale |
| 7,582,419 | B2 | 9/2009 | Meade |
| 7,595,153 | B2 | 9/2009 | Meade |
| 7,601,507 | B2 | 10/2009 | O'Connor et al. |
| 7,607,460 | B2 | 10/2009 | Johns et al. |
| 7,644,898 | B2 | 1/2010 | White et al. |
| 7,648,835 | B2 | 1/2010 | Breidford et al. |
| 7,655,129 | B2 | 2/2010 | Blackburn et al. |
| 7,655,190 | B2 | 2/2010 | Satou et al. |
| 7,659,089 | B2 | 2/2010 | Hasenbank et al. |
| 7,669,597 | B2 | 3/2010 | Sullivan et al. |
| 7,670,559 | B2 | 3/2010 | Chien et al. |

(56) References Cited

U.S. PATENT DOCUMENTS

| | | | |
|---|---|---|---|
| 7,713,711 | B2 | 5/2010 | O'Connor et al. |
| 7,727,723 | B2 | 6/2010 | Pollack et al. |
| 7,731,906 | B2 | 6/2010 | Handique et al. |
| 7,736,891 | B2 | 6/2010 | Nelson et al. |
| 7,759,073 | B2 | 7/2010 | O'Connor et al. |
| 7,763,453 | B2 | 7/2010 | Clemmens et al. |
| 7,763,471 | B2 | 7/2010 | Pamula et al. |
| 7,789,270 | B2 | 9/2010 | Tanaami et al. |
| 7,794,669 | B2 | 9/2010 | Gyonouchi et al. |
| 7,815,871 | B2 | 10/2010 | Pamula et al. |
| 7,816,121 | B2 | 10/2010 | Pollack et al. |
| 7,820,030 | B2 | 10/2010 | Althaus et al. |
| 7,820,391 | B2 | 10/2010 | Chunlin |
| 7,822,510 | B2 | 10/2010 | Paik et al. |
| 7,833,708 | B2 | 11/2010 | Enzelberger et al. |
| 7,851,184 | B2 | 12/2010 | Pollack et al. |
| 7,854,897 | B2 | 12/2010 | Tanaami et al. |
| 7,858,045 | B2 | 12/2010 | Tanaami et al. |
| 7,863,035 | B2 | 1/2011 | Clemens et al. |
| 7,867,757 | B2 | 1/2011 | Karlsen et al. |
| 7,901,947 | B2 | 3/2011 | Pollack et al. |
| 7,910,294 | B2 | 3/2011 | Karlsen |
| 7,914,994 | B2 | 3/2011 | Petersen et al. |
| 7,919,330 | B2 | 4/2011 | De Guzman et al. |
| 7,935,316 | B2 | 5/2011 | Gyonouchi et al. |
| 7,935,481 | B1 | 5/2011 | Umek et al. |
| 7,935,537 | B2 | 5/2011 | Haley |
| 7,939,021 | B2 | 5/2011 | Smith et al. |
| 7,943,030 | B2 | 5/2011 | Shenderov |
| 7,955,836 | B2 | 6/2011 | Clemmens et al. |
| 7,987,022 | B2 | 7/2011 | Handique et al. |
| 7,998,436 | B2 | 8/2011 | Pollack et al. |
| 7,998,708 | B2 | 8/2011 | Handique et al. |
| 8,007,739 | B2 | 8/2011 | Pollack et al. |
| 8,012,743 | B2 | 9/2011 | Bamdad et al. |
| 8,017,340 | B2 | 9/2011 | Collier et al. |
| 8,041,463 | B2 | 10/2011 | Pollack et al. |
| 8,048,628 | B2 | 11/2011 | Pollack et al. |
| 8,053,239 | B2 | 11/2011 | Wheeler et al. |
| 8,088,578 | B2 | 1/2012 | Hua et al. |
| 8,093,062 | B2 | 1/2012 | Winger |
| 8,101,403 | B2 | 1/2012 | Yager et al. |
| 8,101,431 | B2 | 1/2012 | McDevitt et al. |
| 8,105,477 | B2 | 1/2012 | Althaus et al. |
| 8,105,783 | B2 | 1/2012 | Handique |
| 8,105,849 | B2 | 1/2012 | McDevitt et al. |
| 8,110,392 | B2 | 2/2012 | Battrell et al. |
| 8,114,661 | B2 | 2/2012 | O'Connor et al. |
| 8,129,118 | B2 | 3/2012 | Weindel et al. |
| 8,133,671 | B2 | 3/2012 | Williams et al. |
| 8,133,703 | B2 | 3/2012 | Ching et al. |
| 8,137,917 | B2 | 3/2012 | Pollack et al. |
| 8,168,442 | B2 | 5/2012 | Petersen et al. |
| 8,187,864 | B2 | 5/2012 | Wheeler et al. |
| 8,201,765 | B2 | 6/2012 | Rajagopal et al. |
| 8,202,686 | B2 | 6/2012 | Pamula et al. |
| 8,202,736 | B2 | 6/2012 | Mousa et al. |
| 8,208,146 | B2 | 6/2012 | Srinivasan et al. |
| 8,216,529 | B2 | 7/2012 | Ade et al. |
| 8,216,832 | B2 | 7/2012 | Battrell et al. |
| 8,222,023 | B2 | 7/2012 | Battrell et al. |
| 8,247,176 | B2 | 8/2012 | Petersen et al. |
| 8,247,191 | B2 | 8/2012 | Ritzen et al. |
| 8,268,246 | B2 | 9/2012 | Srinivasan et al. |
| 8,273,308 | B2 | 9/2012 | Handique et al. |
| 8,304,253 | B2 | 11/2012 | Yi et al. |
| 8,313,698 | B2 | 11/2012 | Pollack et al. |
| 8,313,895 | B2 | 11/2012 | Pollack et al. |
| 8,317,990 | B2 | 11/2012 | Pamula et al. |
| 8,318,109 | B2 | 11/2012 | Saltsman et al. |
| 8,318,439 | B2 | 11/2012 | Battrell et al. |
| 8,323,900 | B2 | 12/2012 | Handique et al. |
| 8,329,453 | B2 | 12/2012 | Battrell et al. |
| 8,338,166 | B2 | 12/2012 | Beer et al. |
| 8,343,636 | B2 | 1/2013 | Jen et al. |
| 8,349,276 | B2 | 1/2013 | Pamula et al. |
| 8,356,763 | B2 | 1/2013 | Rajagopal et al. |
| 8,364,315 | B2 | 1/2013 | Sturmer et al. |
| 8,367,370 | B2 | 2/2013 | Wheeler et al. |
| 8,372,340 | B2 | 2/2013 | Bird et al. |
| 8,388,909 | B2 | 3/2013 | Pollack et al. |
| 8,389,297 | B2 | 3/2013 | Pamula et al. |
| 8,394,608 | B2 | 3/2013 | Ririe et al. |
| 8,394,641 | B2 | 3/2013 | Winger |
| 8,404,440 | B2 | 3/2013 | Solli et al. |
| 8,426,213 | B2 | 4/2013 | Eckhardt et al. |
| 8,426,214 | B2 | 4/2013 | Stayton et al. |
| 8,431,389 | B2 | 4/2013 | Battrell et al. |
| 8,440,392 | B2 | 5/2013 | Pamula et al. |
| 8,454,905 | B2 | 6/2013 | Pope et al. |
| 8,460,528 | B2 | 6/2013 | Pollack et al. |
| 8,470,606 | B2 | 6/2013 | Srinivasan et al. |
| 8,481,125 | B2 | 7/2013 | Yi et al. |
| 8,492,168 | B2 | 7/2013 | Srinivasan et al. |
| 8,501,921 | B2 | 8/2013 | Bamdad et al. |
| 8,506,908 | B2 | 8/2013 | Benn et al. |
| 8,518,662 | B2 | 8/2013 | Ritzen et al. |
| 8,541,176 | B2 | 9/2013 | Pamula et al. |
| 8,551,424 | B2 | 10/2013 | Abraham-Fuchs et al. |
| 8,557,198 | B2 | 10/2013 | Saltsman et al. |
| 8,562,807 | B2 | 10/2013 | Srinivasan et al. |
| 8,580,209 | B2 | 11/2013 | Kurowski et al. |
| 8,591,830 | B2 | 11/2013 | Sudarsan et al. |
| 8,592,217 | B2 | 11/2013 | Eckhardt |
| 8,613,889 | B2 | 12/2013 | Pollack et al. |
| 8,637,317 | B2 | 1/2014 | Pamula et al. |
| 8,637,324 | B2 | 1/2014 | Pollack et al. |
| 8,658,111 | B2 | 2/2014 | Srinivasan et al. |
| 8,663,974 | B2 | 3/2014 | Brown et al. |
| D702,364 | S | 4/2014 | Iqbal |
| 8,685,344 | B2 | 4/2014 | Sudarsan et al. |
| 8,685,754 | B2 | 4/2014 | Pollack et al. |
| 8,701,906 | B1 | 4/2014 | Anderson |
| 8,795,607 | B2 | 8/2014 | Kurowski et al. |
| 8,951,781 | B2 | 2/2015 | Reed et al. |
| 9,040,288 | B2 | 5/2015 | Handique et al. |
| 9,211,538 | B2 | 12/2015 | Weber |
| 9,222,623 | B2 | 12/2015 | Wright et al. |
| 9,260,475 | B2 | 2/2016 | Irvine et al. |
| 9,410,663 | B2 | 8/2016 | Wright et al. |
| 9,453,613 | B2 | 9/2016 | Wright et al. |
| 9,498,778 | B2 | 11/2016 | Corey et al. |
| 9,557,295 | B2 | 1/2017 | Kayyem |
| 9,598,722 | B2 | 3/2017 | Wright et al. |
| D800,337 | S | 10/2017 | Daines |
| D804,808 | S | 12/2017 | Ukrainsky |
| D815,752 | S | 4/2018 | Jackson |
| D815,754 | S | 4/2018 | Morkos et al. |
| 9,957,553 | B2 | 5/2018 | Kayyem et al. |
| D830,573 | S | 10/2018 | Poirier |
| D831,224 | S | 10/2018 | Hsu |
| 2002/0006643 | A1 | 1/2002 | Kayyem et al. |
| 2002/0066677 | A1 | 6/2002 | Moscovitz |
| 2002/0068357 | A1 | 6/2002 | Mathies et al. |
| 2003/0025129 | A1 | 2/2003 | Hahn et al. |
| 2003/0034271 | A1 | 2/2003 | Burridge |
| 2003/0038040 | A1 | 2/2003 | Bertl et al. |
| 2003/0048631 | A1 | 3/2003 | Ladyjensky |
| 2003/0197139 | A1 | 10/2003 | Williams |
| 2004/0037739 | A1 | 2/2004 | McNeely et al. |
| 2004/0053290 | A1 | 3/2004 | Terbrueggen et al. |
| 2004/0137607 | A1 | 7/2004 | Tanaami et al. |
| 2004/0185551 | A1 | 9/2004 | Niehaus |
| 2004/0229378 | A1 | 11/2004 | Schulte et al. |
| 2004/0254559 | A1 | 12/2004 | Tanaami et al. |
| 2005/0003399 | A1 | 1/2005 | Blackburn et al. |
| 2005/0064423 | A1 | 3/2005 | Higuchi et al. |
| 2005/0164373 | A1 | 7/2005 | Oldham et al. |
| 2005/0182301 | A1 | 8/2005 | Acker et al. |
| 2005/0201903 | A1 | 9/2005 | Weigl et al. |
| 2005/0205816 | A1 | 9/2005 | Hayenga et al. |
| 2005/0233440 | A1 | 10/2005 | Scurati et al. |
| 2005/0244308 | A1 | 11/2005 | Tanaami et al. |
| 2006/0040379 | A1 | 2/2006 | Tanaami et al. |

(56) References Cited

U.S. PATENT DOCUMENTS

2006/0057581 A1 3/2006 Karlsen et al.
2006/0079834 A1 4/2006 Tennican et al.
2006/0166233 A1 7/2006 Wu et al.
2006/0183216 A1 8/2006 Handique et al.
2006/0246575 A1 11/2006 Lancaster et al.
2006/0257993 A1 11/2006 McDevitt et al.
2006/0264782 A1 11/2006 Holmes et al.
2006/0275813 A1 12/2006 Tanaami et al.
2006/0275852 A1 12/2006 Montagu et al.
2007/0013733 A1 1/2007 Katsurai et al.
2007/0017927 A1 1/2007 D'Amore et al.
2007/0042427 A1 2/2007 Gerdes et al.
2007/0098600 A1 5/2007 Kayyem
2007/0178529 A1 8/2007 Breidford et al.
2007/0184547 A1 8/2007 Handique et al.
2007/0219480 A1 9/2007 Kamen et al.
2007/0241068 A1 10/2007 Pamula et al.
2007/0242105 A1 10/2007 Srinivasan et al.
2007/0275415 A1 11/2007 Srinivasan et al.
2007/0292941 A1 12/2007 Handique et al.
2008/0038810 A1 2/2008 Pollack et al.
2008/0050287 A1 2/2008 Araragi et al.
2008/0056948 A1 3/2008 Dale
2008/0182301 A1 7/2008 Handique et al.
2008/0227185 A1 9/2008 Schonfeld et al.
2008/0230386 A1 9/2008 Srinivasan et al.
2008/0248590 A1 10/2008 Gulliksen et al.
2008/0274513 A1 11/2008 Shenderov et al.
2008/0283439 A1 11/2008 Sullivan et al.
2008/0314167 A1 12/2008 Kahl
2009/0022624 A1 1/2009 Saltsman et al.
2009/0061450 A1 3/2009 Hunter
2009/0148847 A1 6/2009 Kokoris et al.
2009/0155902 A1 6/2009 Pollack et al.
2009/0171311 A1* 7/2009 Genosar ..... A61J 1/1406
604/411
2009/0180931 A1 7/2009 Silbert et al.
2009/0182575 A1 7/2009 Warner et al.
2009/0197778 A1 8/2009 Lepschi et al.
2009/0221059 A1 9/2009 Williams et al.
2009/0221091 A1 9/2009 Mogi et al.
2009/0223989 A1 9/2009 Gelardi
2009/0263834 A1 10/2009 Sista et al.
2009/0298059 A1 12/2009 Gumbach et al.
2009/0304944 A1 12/2009 Sudarsan et al.
2009/0325276 A1 12/2009 Battrell et al.
2010/0025250 A1 2/2010 Pamula et al.
2010/0032293 A1 2/2010 Pollack et al.
2010/0035349 A1 2/2010 Bau et al.
2010/0048410 A1 2/2010 Shenderov et al.
2010/0068764 A1 3/2010 Sista et al.
2010/0087012 A1 4/2010 Shenderov
2010/0116640 A1 5/2010 Pamula et al.
2010/0120130 A1 5/2010 Srinivasan et al.
2010/0130369 A1 5/2010 Shenderov et al.
2010/0150783 A1 6/2010 Araragi et al.
2010/0151475 A1 6/2010 Tanaami et al.
2010/0178697 A1 7/2010 Doebler et al.
2010/0190263 A1 7/2010 Srinivasan et al.
2010/0194408 A1 8/2010 Sturmer et al.
2010/0206094 A1 8/2010 Shenderov
2010/0224511 A1 9/2010 Boatner
2010/0226199 A1 9/2010 Mogi et al.
2010/0233824 A1 9/2010 Verhoeckx et al.
2010/0236928 A1 9/2010 Srinivasan et al.
2010/0236929 A1 9/2010 Pollack et al.
2010/0270156 A1 10/2010 Srinivasan et al.
2010/0279374 A1 11/2010 Sista et al.
2010/0282608 A1 11/2010 Srinivasan et al.
2010/0282609 A1 11/2010 Pollack et al.
2010/0288789 A1 11/2010 Tanaami et al.
2010/0291578 A1 11/2010 Pollack et al.
2010/0291588 A1 11/2010 McDevitt et al.
2010/0297754 A1 11/2010 Solli et al.
2010/0304986 A1 12/2010 Chen et al.
2010/0307917 A1 12/2010 Srinivasan et al.
2010/0307922 A1 12/2010 Wu
2010/0308051 A1 12/2010 Weber
2010/0311599 A1 12/2010 Wheeler et al.
2010/0317093 A1 12/2010 Turewicz et al.
2010/0323405 A1 12/2010 Pollack et al.
2010/0331522 A1 12/2010 Irvine et al.
2011/0048951 A1 3/2011 Wu
2011/0053289 A1 3/2011 Lowe et al.
2011/0076692 A1 3/2011 Sista et al.
2011/0086377 A1 4/2011 Thwar et al.
2011/0091989 A1 4/2011 Sista et al.
2011/0097763 A1 4/2011 Pollack et al.
2011/0104725 A1 5/2011 Pamula et al.
2011/0104747 A1 5/2011 Pollack et al.
2011/0104816 A1 5/2011 Pollack et al.
2011/0114490 A1 5/2011 Pamula et al.
2011/0143339 A1 6/2011 Wisniewski
2011/0159578 A1 6/2011 Godsey et al.
2011/0180571 A1 7/2011 Srinivasan et al.
2011/0186433 A1 8/2011 Pollack et al.
2011/0186466 A1 8/2011 Kurowski et al.
2011/0203930 A1 8/2011 Pamula et al.
2011/0207621 A1 8/2011 Montagu et al.
2011/0209998 A1 9/2011 Shenderov
2011/0240471 A1 10/2011 Wheeler et al.
2011/0303542 A1 12/2011 Srinivasan et al.
2011/0311980 A1 12/2011 Pollack et al.
2011/0318824 A1 12/2011 Tanaami et al.
2011/0319279 A1 12/2011 Montagu et al.
2012/0018306 A1 1/2012 Srinivasan et al.
2012/0022695 A1 1/2012 Handique et al.
2012/0044299 A1 2/2012 Winger
2012/0064597 A1 3/2012 Clemmens et al.
2012/0071342 A1 3/2012 Lochhead et al.
2012/0083046 A1 4/2012 Watson et al.
2012/0085645 A1 4/2012 Mousa et al.
2012/0107811 A1 5/2012 Kelso et al.
2012/0122108 A1 5/2012 Handique et al.
2012/0132528 A1 5/2012 Shenderov et al.
2012/0142070 A1 6/2012 Battrell et al.
2012/0156112 A1 6/2012 Sprague et al.
2012/0156750 A1 6/2012 Battrell et al.
2012/0160826 A1 6/2012 Handique
2012/0164627 A1 6/2012 Battrell et al.
2012/0165238 A1 6/2012 Pamula et al.
2012/0171759 A1 7/2012 Williams et al.
2012/0177543 A1 7/2012 Battrell et al.
2012/0187117 A1 7/2012 Weber
2012/0196280 A1 8/2012 Karlsen et al.
2012/0252008 A1 10/2012 Brown et al.
2012/0261264 A1 10/2012 Srinivasan et al.
2012/0270305 A1 10/2012 Reed et al.
2012/0271127 A1 10/2012 Battrell et al.
2012/0329142 A1 12/2012 Battrell et al.
2013/0011912 A1 1/2013 Battrell et al.
2013/0017544 A1 1/2013 Eckhardt et al.
2013/0018611 A1 1/2013 Sturmer
2013/0059366 A1 3/2013 Pollack et al.
2013/0118901 A1 5/2013 Pollack et al.
2013/0130262 A1 5/2013 Battrell et al.
2013/0130936 A1 5/2013 Eckhardt
2013/0142708 A1 6/2013 Battrell et al.
2013/0146461 A1 6/2013 Pamula et al.
2013/0164742 A1 6/2013 Pollack et al.
2013/0178374 A1 7/2013 Eckhardt et al.
2013/0178968 A1 7/2013 Sturmer et al.
2013/0203606 A1 8/2013 Pollack et al.
2013/0217103 A1 8/2013 Bauer
2013/0217113 A1 8/2013 Srinivasan et al.
2013/0225450 A1 8/2013 Pollack et al.
2013/0225452 A1 8/2013 Pollack et al.
2013/0230875 A1 9/2013 Pamula et al.
2013/0233425 A1 9/2013 Srinivasan et al.
2013/0233712 A1 9/2013 Pamula et al.
2013/0252262 A1 9/2013 Srinivasan et al.
2013/0302787 A1 11/2013 Agarwal et al.
2013/0327672 A1 12/2013 Kurowski et al.
2013/0331298 A1 12/2013 Rea

(56) References Cited

U.S. PATENT DOCUMENTS

| | | | |
|---|---|---|---|
| 2013/0341231 | A1 | 12/2013 | Lange et al. |
| 2014/0000223 | A1 | 1/2014 | Osterloh et al. |
| 2014/0000735 | A1 | 1/2014 | Weber et al. |
| 2014/0045275 | A1 | 2/2014 | Rothacher et al. |
| 2014/0127773 | A1 | 5/2014 | Brown et al. |
| 2014/0160877 | A1 | 6/2014 | Lange et al. |
| 2014/0170641 | A1 | 6/2014 | Macemon |
| 2014/0194305 | A1 | 7/2014 | Kayyem et al. |
| 2014/0220702 | A1 | 8/2014 | Johnson et al. |
| 2014/0252079 | A1 | 9/2014 | Bjerke et al. |
| 2014/0255275 | A1 | 9/2014 | Barry et al. |
| 2014/0261708 | A1 | 9/2014 | Wright et al. |
| 2014/0263439 | A1 | 9/2014 | Wright et al. |
| 2014/0322706 | A1 | 10/2014 | Kayyem et al. |
| 2014/0370609 | A1 | 12/2014 | Frank et al. |
| 2015/0024436 | A1 | 1/2015 | Eberhart et al. |
| 2015/0024480 | A1 | 1/2015 | Doebler et al. |
| 2015/0132860 | A1 | 5/2015 | Cook et al. |
| 2015/0298118 | A1 | 10/2015 | Chard et al. |
| 2015/0323555 | A1 | 11/2015 | Kayyem et al. |
| 2015/0346097 | A1 | 12/2015 | Battrell et al. |
| 2016/0129437 | A1 | 5/2016 | Kayyem et al. |
| 2016/0129445 | A1 | 5/2016 | Corey et al. |
| 2016/0130640 | A1 | 5/2016 | Wright et al. |
| 2016/0131672 | A1 | 5/2016 | Tieman |
| 2016/0146803 | A1 | 5/2016 | Allen et al. |
| 2016/0339426 | A1 | 11/2016 | Wright et al. |
| 2017/0181314 | A1 | 6/2017 | Leigh et al. |
| 2018/0015454 | A1 | 1/2018 | Wright |
| 2018/0095100 | A1 | 4/2018 | Nguyen |
| 2018/0223345 | A1 | 8/2018 | Kayyem et al. |

FOREIGN PATENT DOCUMENTS

| | | | |
|---|---|---|---|
| EP | 0583833 | A2 | 2/1994 |
| EP | 0694483 | B1 | 1/1996 |
| EP | 0870541 | A2 | 10/1998 |
| JP | 2002518690 | A | 6/2002 |
| JP | 2002542461 | A | 12/2002 |
| JP | 2009134512 | A | 6/2009 |
| JP | 2009161187 | A | 7/2009 |
| JP | 2009199617 | A | 9/2009 |
| JP | 2009534653 | A | 9/2009 |
| JP | 2010169693 | A | 8/2010 |
| JP | 2011520449 | A | 7/2011 |
| JP | 2011252768 | A | 12/2011 |
| JP | 2012055321 | A | 3/2012 |
| WO | WO 1999037819 | | 7/1999 |
| WO | WO 9967425 | A2 | 12/1999 |
| WO | WO 00/62931 | A1 | 10/2000 |
| WO | WO 0062931 | A1 | 10/2000 |
| WO | WO 01/10729 | A1 | 2/2001 |
| WO | WO 2004011148 | A2 | 2/2004 |
| WO | WO 2004034028 | A2 | 4/2004 |
| WO | WO 2005/083423 | | 9/2005 |
| WO | WO 2007044917 | A2 | 4/2007 |
| WO | WO 2007112114 | A2 | 10/2007 |
| WO | WO 2007120241 | A2 | 10/2007 |
| WO | WO 2009089466 | A2 | 7/2009 |
| WO | WO 2009/140373 | A2 | 11/2009 |
| WO | WO 2009140373 | A2 | 11/2009 |
| WO | WO 2010025302 | A2 | 3/2010 |
| WO | WO 2010/151705 | | 12/2010 |
| WO | WO 2010151705 | A2 | 12/2010 |
| WO | WO 2011034668 | A1 | 3/2011 |
| WO | WO 2011106314 | A2 | 9/2011 |
| WO | WO 2011127040 | A2 | 10/2011 |
| WO | 2012054588 | A2 | 4/2012 |
| WO | 2012/062648 | A1 | 5/2012 |
| WO | WO 2012080190 | A1 | 6/2012 |
| WO | WO 2012084615 | A1 | 6/2012 |
| WO | WO 2012117029 | A1 | 9/2012 |
| WO | WO 2012/151192 | | 11/2012 |
| WO | WO 2013059750 | A1 | 4/2013 |
| WO | WO 2014049371 | A2 | 4/2014 |
| WO | WO 2014/066704 | | 5/2014 |
| WO | WO-2014049371 | A3 * | 5/2014 ..... B01L 3/50273 |
| WO | WO 2015/191916 | | 12/2015 |

OTHER PUBLICATIONS

US Office Action dated Jun. 6, 2018 issued in related U.S. Appl. No. 15/227,188 (29 pages).

Extended European Search Report issued in European Patent Application No. 16151365.0, 4 pages (dated May 23, 2016).

International Search Report and Written Opinion issued in International Patent Application No. PCT/US2015/059978, 23 pages (dated Jun. 27, 2016).

Notice of Allowance issued in U.S. Appl. No. 14/206,903, 16 pages (dated May 11, 2016).

Notice of Allowance issued in U.S. Appl. No. 14/538,565, 55 pages (dated Jul. 11, 2016).

Supplemental Notice of Allowance issued in U.S. Appl. No. 14/206,817, 3 pages (dated Jul. 12, 2016).

Corrected Notice of Allowance issued in U.S. Appl. No. 14/538,565, 10 pages (dated Jul. 29, 2016).

Advisory Action issued in U.S. Appl. No. 14/062,860, 7 pages (dated Jul. 21, 2016).

Final Office Action issued in U.S. Appl. No. 14/062,865, 41 pages (dated Jul. 21, 2016).

Australian Examination Report No. 2 dated Feb. 20, 2018 issued in Australian Patent Application No. 2013334189. (4 pages).

International Search Report and Written Opinion issued in International Patent Application No. PCT/US2015/059947, 31 pages (dated Apr. 21, 2017).

Non-final Office Action issued in U.S. Appl. No. 14/807,000, 69 pages (dated May 1, 2017).

Office Action (and English translation) issued in Chinese Patent Application No. 201480027615.1, 9 pages (dated Aug. 11, 2016).

Notice of Allowance issued in U.S. Appl. No. 14/538,533, 59 pages (dated Nov. 10, 2016).

Non-final Office Action issued in U.S. Appl. No. 14/948,819, (dated Sep. 14, 2017), 70 pages.

Non-final Office Action issued in U.S. Appl. No. 15/227,188, (dated Oct. 10, 2017), 13 pages.

Examination Report issued in Australian Patent Application No. 2013334189, 4 pages (dated Sep. 11, 2017).

"Mechanisms Information/Worksheets," World Association of Technology Teachers, 2 pages (Mar. 2, 2011). (animated display viewable at https://web.archive.org/web/20110302093447/http://www.technologystudent.com/cams/flat1.htm ).

Beaucage et al., "Tetrahedron Report No. 329: The Functionalization of Oligonucleotides Via Phosphoramidite Derivatives," *Tetrahedron* vol. 49, No. 10, pp. 1925-2963 (1993).

Bolli et al., "α-Bicyclo-DNA: Synthesis, Characterization, and Pairing Properties of α-DNA-Analogues with Restricted Conformational Flexibility in the Sugar-Phosphate Backbone," *American Chemical Society,* pp. 100-117 (1994).

Brill et. al., "Synthesis of Oligodeoxynucleoside Phosphorodithioates via Thioamidites," *J. Am. Chem. Soc.,* pp. 2321-2322 (1989).

Carlsson et al., "Screening for Genetic Mutations" *Letters to Nature,* vol. 380, p. 207 (Mar. 1996).

Dempcy et al., "Synthesis of a Thymidyl Pentamer of Deoxyribonucleic Guanidine and Binding Studies with DNA Homopolynucleotides," *Proc. Natl. Acad. Sci. USA,* vol. 92, pp. 6097-6101 (Jun. 1995).

Dobson et al., "Emerging Technologies for Point-of-Care Genetic Testing," *Future Drugs Ltd* (www.future-drugs.com), 10.1586/14737159.7.4.359, Expert Rev. Mol. Diagn., pp. 359-370 (2007).

Doebler et al., "Continuous-Flow, Rapid Lysis Devices for Biodefense Nucleic Acid Diagnostic Systems," *The Association for Laboratory Automation* (JALA), pp. 119-125 (Jun. 2009).

Egholm et al., "Peptide Nucleic Acids (PNA). Oligonucleotide Analogues with an Achiral Peptide Backbone,"*J.Am.Chem.Soc.,* pp. 1895-1897 (1992).

(56) References Cited

OTHER PUBLICATIONS

Egholm et al., "PNA hybridizes to complementary oligonucleotides obeying the Watson-Crick hydrogen-bonding rules," *Letters to Nature,* pp. 566-568 (1993).
Erickson et al., "Integrated Microfluidic Devices," *Elsevier B.V.,* 16 pages (2003).
European Patent Office Communication Pursuant to Article 94(3) EPC in European Patent Application No. 15168733.2, 3 pages (dated Feb. 19, 2016).
Extended European Search Report issued in European Patent Application No. 138496757, 5 pages (dated Oct. 12, 2015).
Extended European Search Report issued in European Patent Application No. 15168733.2, 3 pages (dated Dec. 15, 2015).
Final Office Action issued in U.S. Appl. No. 14/062,860, 32 pages (dated Feb. 11, 2016).
Findlay et al., "Automated Closed-Vessel System for in Vitro Diagnostics Based on Polymerase Chain Reaction," *Clinical Chemistry,* 39:9, pp. 1927-1933, 1993).
Focke et al., "Lab-on-a-Foil: Microfluidics on Thin and Flexible Films," *The Royal Society of Chemistry,* pp. 1365-1386 (2010).
Herdewijn et al., "Hexopyranosyl-Like Oligonucleotides," *American Chemical Society,* pp. 80-99 (1994).
Horn et al., "Oligonucleotides with Alternating Anionic and Cationic Phosphoramidate Linkages: Synthesis and Hybridization of Stereo-Uniform Isomers," *Tetrahedron Letters,* vol. 37, No. 6, pp. 743-746 (1996).
International Preliminary Report on Patentability and Written Opinion issued in International Application No. PCT/US2013/06617, 15 pages (dated Apr. 28, 2015).
International Preliminary Report on Patentability issued in International Application No. PCT/US2014/024499, 9 pages (dated Sep. 24, 2015).
International Search Report and Written Opinion issued in Application No. PCT/US2013/0066717, 35 pages (dated Feb. 3, 2014).
International Search Report and Written Opinion issued in International Patent Application No. PCT/US2014/024499, 14 pages (dated Dec. 11, 2014).
International Search Report and Written Opinion issued in International Application No. PCT/US2013/06617, 35 pages (dated Feb. 3, 2014).
Invitation to Pay Additional Fees and, Where Applicable, Protest Fee, including partial international search results, issued by the International Searching Authority in International Patent Application No. PCT/US2015/059978, 10 pages (dated Feb. 23, 2016).
Jeffs et al., "Unusual Confirmation of a 3-Thioformacetal Linkage in a DNA Duples," *Journal of Biomedecular NMR,* pp. 17-34 (1994).
Jenkins et al., "The Biosynthesis of Carbocyclic Nucleosides," *Chemical Society Reviews,* pp. 169-176 (Jan. 1995).
Kiedrowski et al., "Parabolic Growth of a Self-Replicating Hexadeoxynucleotide Bearing a 3'5' Phosphoamidate Linkage," *Angew Chem. Intl. Ed. English 30,* pp. 423-426 (1991).
Koshkin et al., "LNA (Locked Nucleic Acid): An RNA Mimic Forming Exceedingly Stable LNA: LNA Duplexes,"*J. Am. Chem. Soc.,* vol. 120, pp. 13252-13253 (1998).
Letsinger et al., "Caionic Oligonucleotides," *J. Am. Chem. Soc.,* pp. 4470-4471 (1988).
Letsinger et al., "Effects of Pendant Groups at Phosphorus on Binding Properties of d-APA Analogues," *Nucleic Acids Research* vol. 14, No. 8, pp. 3487-3499 (1986).
Letsinger et al., "Hybridization of Alternating Cationic/ Anionic Oligonucleotides to RNA Segments," *Nucleosides & Nucleotides* vol. 13, No. 6&7, pp. 1597-1605 (1994).
Letsinger et al., "Phosphoramidate Analogues of Oligonucleotides," *J. Org. Chem,* vol. 35, No. 1, pp. 3800-3803 (1970).
Maddry et al., "Synthesis of Nonionic Oligonucleotide Analogues," *American Chemical Society,* pp. 40-51 (1994).
Mag et al., "Synthesis and Selective Clevage of a Oligodeoxynucleotide Containing a Bridged Internucleotide 5 Phosphorothioate Linkage," *Nucleic Acids Research,* vol. 19 No. 7, pp. 1437-1441 (1991).
Malic et al., "Current State of Intellectual Property in Microfluidic Nucleic Acid Analysis," McGill University, *Bentham Science Publishers,* 18 pages (2007).
Meier et al., "Peptide Nucleic Acids (PNA's)-Unusual Properties of Nonionic Oligonucleotide Analogues," *Angew Intl. Ed. English 31,* No. 8, pp. 1008-1010 (1992).
Mesmaeker et al., "Comparison of Rigid and Flexible Backbones in Antisense Oligonucleotides," *Bioorganic & Medicinal Chem. Letters,* vol. 4, No. 3, pp. 395-398 (1994).
Mesmaeker et al., "Novel Backbone Replacements for Oligonucleotides," *American Chemical Society,* pp. 24-39 (1994).
Non-final Office Action issued in U.S. Appl. No. 14/062,860, 67 pages (dated Jul. 23, 2015).
Non-final Office Action issued in U.S. Appl. No. 14/206,903, 47 pages (dated Jan. 21, 2016).
Nonfinal Office Action issued in U.S. Appl. No. 14/062,865, 74 pages (dated Jan. 6, 2016).
Notice of Allowance issued in U.S. Appl. No. 14/206,867, 52 pages (dated Jun. 10, 2015).
Notice of Allowance issued in U.S. Appl. No. 14/206,867, 43 pages (dated Aug. 7, 2015).
Office Action issued in U.S. Appl. No. 14/206,867, 22 pages (dated Nov. 7, 2014).
Pauwels et al., "Biological Activity of New 2-5A Analogues," *Chemica Scripta,* vol. 26, pp. 141-145 (1986).
Rawls "Optomistic About Antisense," *C&EN,* pp. 35-39 (Jun. 1997).
Sawai, "Synthesis and Properties of Oligoadenylic Acids Containing 2'-5' Phosphoramide Linkage," *Chemistry Letters,* pp. 805-808 (1984).
Sprinzl et al., "Enzymatic Incorporation of ATP and CTP Analogues into the 3' end of RNA," *Eur. J. Biochem 81,* pp. 579-589 (1977).
Supplemental Notice of Allowability issued in U.S. Appl. No. 14/206,867, 5 pages (dated Jul. 13, 2015).
Vandeventer et al., "Mechanical Disruption of Lysis-Resistant Bacterial Cells by Use of a Miniature, Low-Power, Disposable Device," American Society for Microbiology, *Journal of Clinical Microbiology,* 49:7, pp. 2533-2539 (Jul. 2011).
Wolf et al., "Single-Tube Nested PCR with Room-Temperature-Stable Reagents," Cold Spring Harbor Laboratory Press ISSN, 1054-9803/95, vol. 4, pp. 376-379 and source page (1995).
Non-final Office Action issued in U.S. Appl. No. 14/206,817, 44 pages (dated Oct. 8, 2015).
Notice of Allowance issued in U.S. Appl. No. 14/206,817, 20 pages (dated Feb. 19, 2016).
Examination Report No. 3 dated May 30, 2018 issued in Australian Patent Application No. 2014235532. (4 pages).
Office Action dated Jul. 27, 2018 issued in U.S. Appl. No. 14/948,819. (24 pages).
Office Action (with English translation) issued in Chinese Patent Application No. 2014800227615.1, 11 pages (dated Feb. 14, 2017).
Final Office Action issued in U.S. Appl. No. 14/062,865, (dated Dec. 12, 2017), 30 pages.
The definition of "oleophobis" provided by the online dictionary at merriam-webster.com [retrieved on Dec. 7, 2017]. Retrieved from the Internet: <URL: www.merriamwebster.com/medical/oleophobic>. (Year: 2017).
Examination Report issued in Australian Patent Application No. 2014235532, 3 pages (dated Aug. 28, 2017).
U.S. Office Action dated Feb. 6, 2018 issued in U.S. Appl. No. 14/807,000, 52 pages.
U.S. Office Action dated Feb. 7, 2018 issued in U.S. Appl. No. 14/948,819, 11 pages.
The definition of "paddle" provided by the online dictionary at dictionary.com [retrieved on Jan. 31, 2018]. Retrieved from the Internet: <URL: www.dictionary.com/browse/paddle>, 5 pages.
Notice of Allowance dated Feb. 8, 2018 issued in U.S. Appl. No. 14/062,865, 9 pages.
Notice to File Corrected Application Papers dated Feb. 13, 2018 issued in U.S. Appl. No. 14/062,865, 3 pages.
Japanese Office Action dated Nov. 28, 2017 issued in Japanese Patent Application No. 2016-501554, 3 pages. (Concise Explanation Attached).

(56) References Cited

OTHER PUBLICATIONS

Japanese Office Action dated Nov. 29, 2017 issued in Japanese Patent Application No. 2017-039634, 2 pages. (Concise Explanation Attached).
Corrected Notice of Allowability dated Feb. 9, 2018 issued in U.S. Appl. No. 14/538,506, 6 pages.
Advisory Action dated Apr. 23, 2018 issued in U.S. Appl. No. 14/948,819. (4 pages).
Non-Final Office Action dated Sep. 5, 2018 issued in U.S. Appl. No. 15/298,729. (84 pages).
Non-Final Office Action dated Oct. 1, 2018 issued in U.S. Appl. No. 14/807,000. (31 pages).
Non-final Office Action issued in U.S. Appl. No. 14/538,506, (dated Jun. 14, 2017), 68 pages.
"Initial" Non-final Office Action issued in U.S. Appl. No. 14/062,865, (dated Jun. 21, 2017) 37 pages.
"Replacement" Non-final Office Action issued in U.S. Appl. No. 14/062,865, (dated Jun. 26, 2017) 25 pages.
International Preliminary Report on Patentability issued in International Patent Application No. PCT/US2015/059947, (dated May 26, 2017), 12 pages.
International Preliminary Report on Patentability issued in International Patent Application No. PCT/US20152015/059978), (dated May 26, 2017), 17 pages.
Notice of Reasons for Rejection (with English translation) issued in Japanese Patent Application No. 2015539818, (dated Jul. 4, 2017) 8 pages.
U.S. Appl. No. 11/883,896, filed Oct. 2009, Graeme Huntley.
U.S. Appl. No. 11/993,705, filed Aug. 2010, John McDevitt et al.
U.S. Appl. No. 62/396,449, filed Sep. 2016, Nguyen.
Office Action issued in Chinese Patent Application No. 2016080801483520 (with English translation), 9 pages (dated Aug. 11, 2016).
Communication 94(3) EPC issued in European Patent Application No. 13849675.7, 3 pages (dated Oct. 6, 2016).
Office Action (Japanese language) issued in Japanese Patent Application No. 2017-039635, 4 pages (dated Jan. 15, 2018). Concise Explanation of Relevance attached.
V. Ryan, "Flat Plate Cam / Linear Cam" [retrieved on Aug. 5, 2014] http://web.archive.org/web/20110302093447/http://www.technologystudent.co-m/cams/flat1.htm, 3 pages.
Liang et al., *Empiric Antimicrobial Therapy in Severe Sepsis and Septic Shock: Optimizing Pathogen Clearance,* Curr Infect Dis Rep. Jul. 2015; 17(7): 36.
Notice of Allowance issued in U.S. Appl. No. 14/538,506, (dated Feb. 9, 2018), 6 pages.
Final Office Action issued in U.S. Appl. No. 14/807,000, (dated Feb. 6, 2018), 37 pages.
Final Office Action in U.S. Appl. No. 14/807,000, 36 pages (dated Mar. 28, 2018), 36 pages.
Final Office Action of U.S. Appl. No. 15/298,729 dated Feb. 25, 2019, 23 pages.
Non-Final Office Action of U.S. Appl. No. 15/298,729, dated Sep. 5, 2018, 15 pages.
Non-final Office Action of U.S. Appl. No. 29/623,931 dated Feb. 21, 2019, 14 pages.
Office Action of U.S. Appl. No. 15/227,188 dated Jun. 6, 2018, 14 pages.
Office Action of U.S. Appl. No. 15/227,188 dated Oct. 10, 2017, 10 pages.
Advisory Action issued in U.S. Appl. No. 14/062,860, 3 pages. (dated Jan. 19, 2017).
Respiratory Pathogen (RP) Panel. Online, published date unknown. Retrieved on Dec. 23, 2018 from URL: https://www.genmarkdx.com/solutions/panels/eplex-panels/respiratory-pathogen-panel/.
Non-Final Office Action in U.S. Appl. No. 29/623,925, 9 pages, (dated Sep. 6, 2018).
International Preliminary Report on Patentability for Application No. PCT/US2017/052248, dated Mar. 28, 2019, 11 pages.

* cited by examiner

APPARATUS AND METHODS FOR MANIPULATING DEFORMABLE FLUID VESSELS

CROSS REFERENCE OF RELATED APPLICATION

This application claims the benefit under 35 U.S.C. § 120 of the filing date of non-provisional patent application Ser. No. 14/206,817 filed Mar. 12, 2014, which claims the benefit under 35 U.S.C. § 119(e) of the filing date of provisional patent application Ser. No. 61/798,091 filed Mar. 15, 2013, the disclosure of which is incorporated herein by reference.

FIELD OF THE INVENTION

Aspects of the invention relate to systems, methods, and apparatus for selectively opening deformable fluid vessels. One aspect of the invention relates to generating compressive forces for compressing deformable fluid vessels to displace fluid therefrom in a low profile instrument. Other aspects of the invention relate to opening the deformable fluid vessel in a manner that reduces the amount of compressive force required to displace fluid from the vessel. Other aspects of the invention relate to an apparatus for protecting the deformable fluid vessel from inadvertent exposure to external forces and for interfacing with the vessel to permit intentional application of external compressive force without removing the vessel-protective features.

BACKGROUND OF INVENTION

The present invention relates to systems, methods, and apparatus for manipulating deformable fluid vessels. An exemplary device having such deformable fluid vessels is shown in FIGS. 1A and 1B. A liquid reagent module 10 includes a substrate 12 on which a plurality of deformable fluid vessels, or blisters, are attached. Devices such as the liquid reagent module 10 are often referred to as cartridges or cards. In an embodiment, the liquid reagent module 10 includes an input port 16, which may comprise a one-way valve, for dispensing a sample fluid into the module 10. A fluid channel 18 carries fluid from the input port 16. A sample vent 14 vents excess pressure from the module 10. A labeled panel 20 may be provided for an identifying label, such as a barcode or other human and/or machine-readable information.

Liquid reagent module 10 further includes a plurality of deformable (collapsible) vessels (blisters), including, in the illustrated embodiment, an elution reagent blister 22, a wash buffer blister 24, a water blister 26, a lysis reagent blister 28, an air blister 30, a binding agent blister 32, and an oil blister 34. Note that the number and types of blisters shown are merely exemplary. Each of the blisters may be interconnected with one or more other blisters and/or the fluid channel 18 by one or more fluid channels formed in or on the substrate 12.

The liquid reagent module 10 may be processed by selectively compressing one or more of the blisters to completely or partially collapse the blister to displace the fluid therefrom. Instruments adapted to process the liquid reagent module 10, or other devices with deformable fluid vessels, include mechanical actuators, e.g., typically pneumatically or electromechanically actuated, constructed and arranged to apply collapsing pressure to the blister(s). Typically, such actuator(s) is(are) disposed and are moved transversely to the plane of the module 10—for example, if module 10 were oriented horizontally within an instrument, actuators may be provided vertically above and/or below the module 10 and would be actuated to move vertically, in a direction generally normal to the plane of the module. The liquid reagent module 10 may be processed in an instrument in which the module 10 is placed into a slot or other low profile chamber for processing. In such a slot, or low profile chamber, providing actuators or other devices that are oriented vertically above and/or below the module 10 and/or move in a vertical direction may not be practical. The pneumatic and/or electromechanical devices for effecting movement of such actuators require space above and/or below the module's substrate, space that may not be available in a slotted or other low profile instrument.

Accordingly, a need exists for methods, systems, and/or apparatus for effecting movement of an actuator for collapsing a vessel within a low profile component space of an instrument.

SUMMARY OF THE INVENTION

Aspects of the invention are embodied in an apparatus for processing a fluid module including a collapsible vessel supported on a planar substrate by applying a force compressing the vessel against the substrate. The apparatus comprises a first actuator component configured to be movable in a first direction that is generally parallel to the plane of the substrate, a second actuator component configured to be movable in a second direction having a component that is generally normal to the plane of the substrate, and a motion conversion mechanism coupling the first actuator component with the second actuator component and constructed and arranged to convert movement of the first actuator component in the first direction into movement of the second actuator component in the second direction.

According to further aspects of the invention, the first actuator component comprises an actuator plate configured to be movable in the first direction and including a cam follower element, the second actuator component comprises a platen configured to be movable in the second direction, and the motion conversion mechanism comprises a cam body having a cam surface. The cam body is coupled to the platen and is configured such that the cam follower element of the actuator plate engages the cam surface of the cam body as the actuator plate moves in the first direction thereby causing movement of the cam body that results in movement of the platen in the second direction.

According to further aspects of the invention, the cam follower element of the actuator plate comprises a roller configured to rotate about an axis of rotation that is parallel to the actuator plate and normal to the first direction, the motion conversion mechanism further comprises a chassis, and the cam body is pivotally attached at one portion thereof to the chassis and at another portion thereof to the platen.

According to further aspects of the invention, the cam surface of the cam body comprises an initial flat portion and a convexly-curved portion, and movement of the roller from the initial flat portion to the convexly-curved portion causes the movement of the cam body that results in movement of the platen in the second direction.

According to further aspects of the invention, the first actuator component comprises a cam rail configured to be movable in the first direction, the second actuator component comprises a platen configured to be movable in the second direction, and the motion conversion mechanism comprises a cam surface and a cam follower coupling the cam rail to the platen and configured to convert motion of the cam rail in the first direction into movement of the platen in the second direction.

According to further aspects of the invention, the cam surface comprises a cam profile slot formed in the cam rail, and the cam follower comprises a follower element coupling the platen to the cam profile slot such that movement of the cam rail in the first direction causes movement of the cam follower within the cam profile slot that results in the movement of the platen in the second direction.

Further aspects of the invention are embodied in an apparatus for displacing fluid from a fluid container. The fluid container includes a first vessel and a second vessel connected or connectable to the first vessel and including a sealing partition preventing fluid flow from the second vessel, and the fluid container further includes an opening device configured to be contacted with the sealing partition to open the sealing partition and permit fluid flow from the second vessel. The apparatus comprises a first actuator configured to be movable with respect to the first vessel to compress the first vessel and displace fluid contents thereof and a second actuator movable with respect to the opening device and configured to contact the opening device and cause the opening device to open the sealing partition, The second actuator is releasably coupled to the first actuator such that the second actuator moves with the first actuator until the second actuator contacts the opening device and causes the opening device to open the sealing partition, after which the second actuator is released from the first actuator and the first actuator moves independently of the second actuator to displace fluid from the first vessel.

Further aspects of the invention are embodied in a fluid container comprising a first vessel, a second vessel connected or connectable to the first vessel, a sealing partition preventing fluid flow from the second vessel, and a spherical opening element initially supported within the second vessel by the sealing partition and configured to be contacted with the sealing partition to open the sealing partition and permit fluid flow from the second vessel.

Further aspects of the invention are embodied in a fluid container comprising a first vessel, a second vessel connected or connectable to the first vessel, a sealing partition preventing fluid flow from the second vessel, and a cantilevered lance having a piercing point and disposed with the piercing point adjacent to the sealing partition and configured to be deflected until the piercing point pierces the sealing partition to permit fluid flow from the second vessel through the pierced sealing partition.

Further aspects of the invention are embodied in a fluid container comprising a first vessel, a second vessel connected or connectable to the first vessel, a sealing partition preventing fluid flow from the second vessel, and a cantilevered lance having a piercing point and being fixed at an end thereof opposite the piercing point, the cantilevered lance being disposed with the piercing point adjacent to the sealing partition and configured to be deflected until the piercing point pierces the sealing partition to permit fluid flow from the second vessel through the pierced sealing partition.

According to further aspects of the invention, the fluid container further comprises a substrate on which the first and second vessels are supported and which includes a chamber formed therein adjacent the sealing partition wherein an end of the cantilevered lance is secured to the substrate and the piercing point of the lance is disposed within the chamber.

Further aspects of the invention are embodied in a fluid container comprising a first vessel, a second vessel connected or connectable to the first vessel, a sealing partition preventing fluid flow from the second vessel, and a lancing pin having a piercing point and disposed with the piercing point adjacent to the sealing partition and configured to be moved with respect to the sealing partition until the piercing point pierces the sealing partition to permit fluid flow from the second vessel through the pierced sealing partition.

According to further aspects of the invention, the lancing pin has a fluid port formed therethrough to permit fluid to flow through the lancing pin after the sealing partition is pierced by the piercing point.

According to further aspects of the invention, the fluid container further comprises a substrate on which the first and second vessels are supported and which includes a chamber formed therein adjacent the sealing partition within which the lancing pin is disposed.

According to further aspects of the invention, the chamber in which the lancing pin is disposed comprises a segmented bore defining a hard stop within the chamber and the lancing pin includes a shoulder that contacts the hard stop to prevent further movement of the lancing pin after the piercing point pierces the sealing partition.

According to further aspects of the invention, the fluid container further comprises a fluid channel extending between the first and second vessels.

According to further aspects of the invention, the fluid container of further comprises a seal within the fluid channel, the seal being configured to be breakable upon application of sufficient force to the seal to thereby connect the first and second vessels via the fluid channel.

Further aspects of the invention are embodied in a fluid container comprising a first vessel, a second vessel disposed within the first vessel, a substrate on which the first and second vessels are supported and having a cavity formed therein adjacent the second vessel, a fixed spike formed within the cavity, and a fluid exit port extending from the cavity, wherein the first and second vessels are configured such that external pressure applied to the first vessel will collapse the second vessel and cause the second vessel to contact and be pierced by the fixed spike, thereby allowing fluid to flow from the first vessel through the pierced second vessel, the cavity, and the fluid exit port.

Further aspects of the invention are embodied in a fluid container comprising a collapsible vessel configured to be collapsed upon application of sufficient external pressure to displace fluid from the vessel, a housing surrounding at least a portion of the collapsible vessel, and a floating compression plate movably disposed within the housing. The housing includes an opening configured to permit an external actuator to contact the floating compression plate within the housing and press the compression plate into the collapsible vessel to collapse the vessel and displace the fluid contents therefrom.

Other features and characteristics of the present invention, as well as the methods of operation, functions of related elements of structure and the combination of parts, and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

The accompanying drawings, which are incorporated herein and form part of the specification, illustrate various, non-limiting embodiments of the present invention. In the drawings, common reference numbers indicate identical or functionally similar elements.

FIG. 13B is a perspective view of a cantilever lance used in the embodiment of

FIG. 13A.

DETAILED DESCRIPTION OF THE INVENTION

Figure 1A:
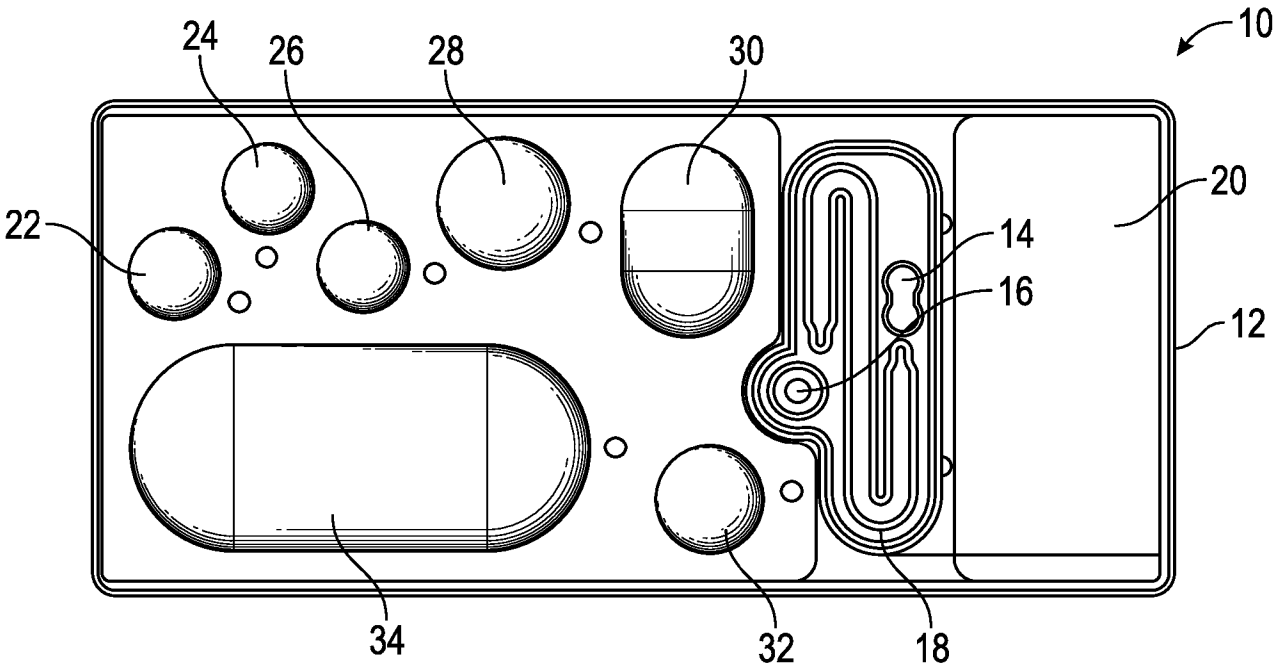
FIG. 1A is a top plan view of a liquid reagent module.
Figure 1B:
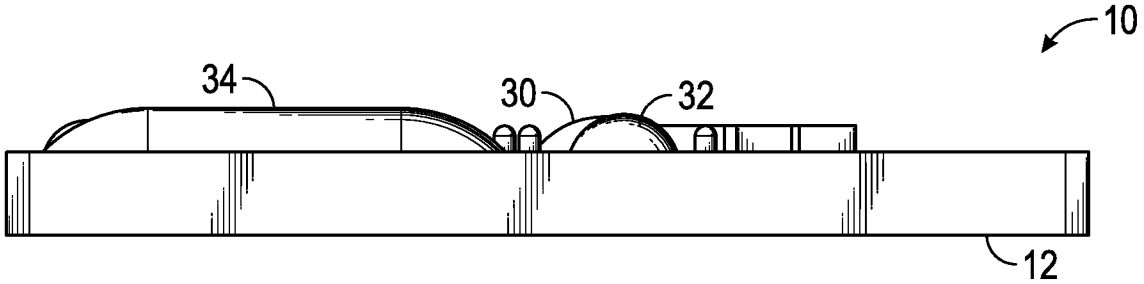
FIG. 1B is a side view of the liquid reagent module.

Unless defined otherwise, all terms of art, notations and other scientific terms or terminology used herein have the same meaning as is commonly understood by one of ordinary skill in the art to which this disclosure belongs. Many of the techniques and procedures described or referenced herein are well understood and commonly employed using conventional methodology by those skilled in the art. As appropriate, procedures involving the use of commercially available kits and reagents are generally carried out in accordance with manufacturer defined protocols and/or parameters unless otherwise noted. All patents, applications, published applications and other publications referred to herein are incorporated by reference in their entirety. If a definition set forth in this section is contrary to or otherwise inconsistent with a definition set forth in the patents, applications, published applications, and other publications that are herein incorporated by reference, the definition set forth in this section prevails over the definition that is incorporated herein by reference.

As used herein, "a" or "an" means "at least one" or "one or more."

This description may use relative spatial and/or orientation terms in describing the position and/or orientation of a component, apparatus, location, feature, or a portion thereof. Unless specifically stated, or otherwise dictated by the context of the description, such terms, including, without limitation, top, bottom, above, below, under, on top of, upper, lower, left of, right of, in front of, behind, next to, adjacent, between, horizontal, vertical, diagonal, longitudinal, transverse, etc., are used for convenience in referring to such component, apparatus, location, feature, or a portion thereof in the drawings and are not intended to be limiting.

Figure 2:
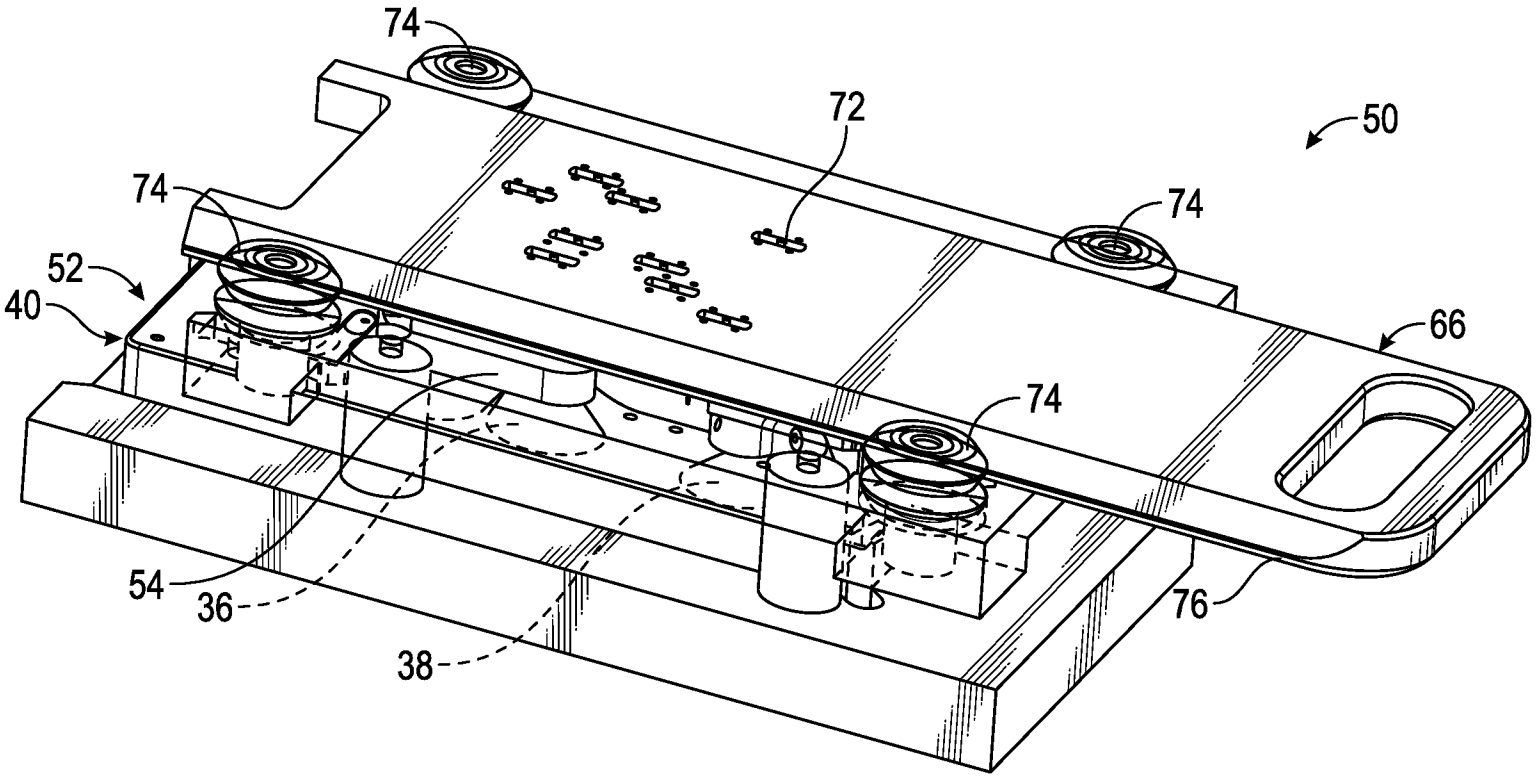
FIG. 2 is a perspective view of a blister compressing actuator mechanism embodying aspects of the present invention.

An actuator mechanism for compressing deformable fluid vessels—such as blisters on a liquid reagent module—embodying aspects of the present invention is shown at reference number 50 in FIG. 2. The actuator mechanism 50 may include an articulated blister actuator platen assembly 52 and a sliding actuator plate 66. The sliding actuator plate 66 is configured to be movable in a direction that is generally parallel to the plane of the liquid reagent module—horizontally in the illustrated embodiment—and may be driven by a linear actuator, a rack and pinion, a belt drive, or other suitable motive means. Sliding actuator plate 66, in the illustrated embodiment, has V-shaped edges 76 that are supported in four V-rollers 74 to accommodate movement of the plate 66 in opposite rectilinear directions, while holding the sliding actuator plate 66 at a fixed spacing from the actuator platen assembly 52. Other features may be provided to guide the actuator plate 66, such as rails and cooperating grooves. A component 40—which may comprise liquid reagent module 10 described above—having one or more deformable fluid vessels, such as blisters 36 and 38, is positioned within the actuator mechanism 50 beneath the articulated blister actuator platen assembly 52.

Further details of the configuration of the articulated blister actuator platen assembly 52 and the operation thereof are shown in FIGS. 3A-6B.

Figure 3A:
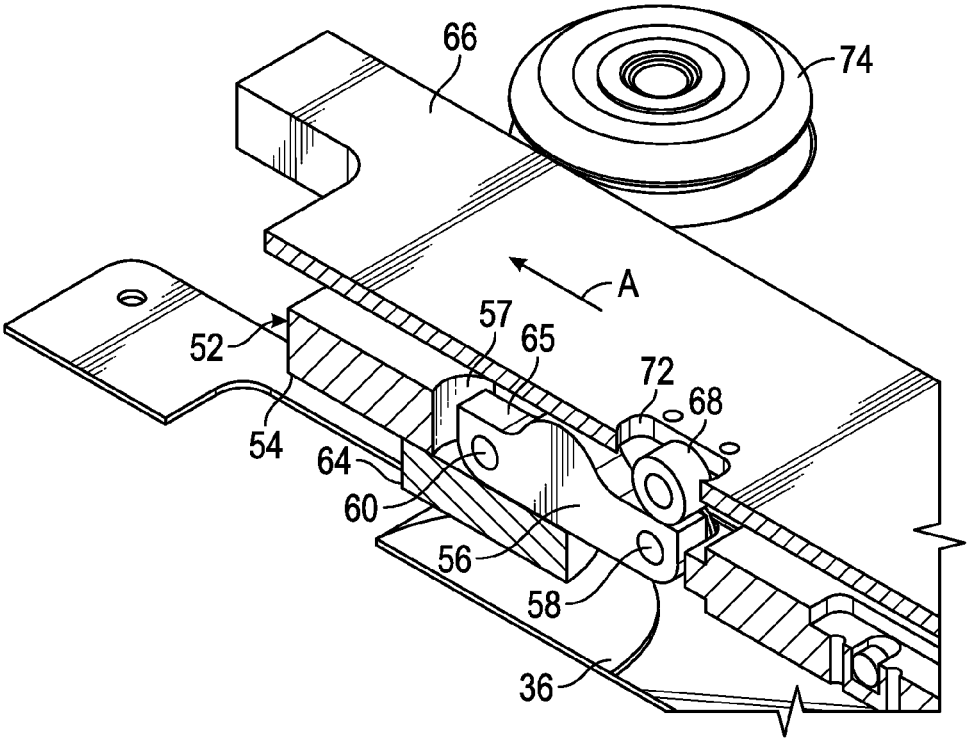
FIG. 3A is a partial, cross-sectional perspective view of the articulated blister actuator platen assembly in an initial, unactuated state.
Figure 3B:
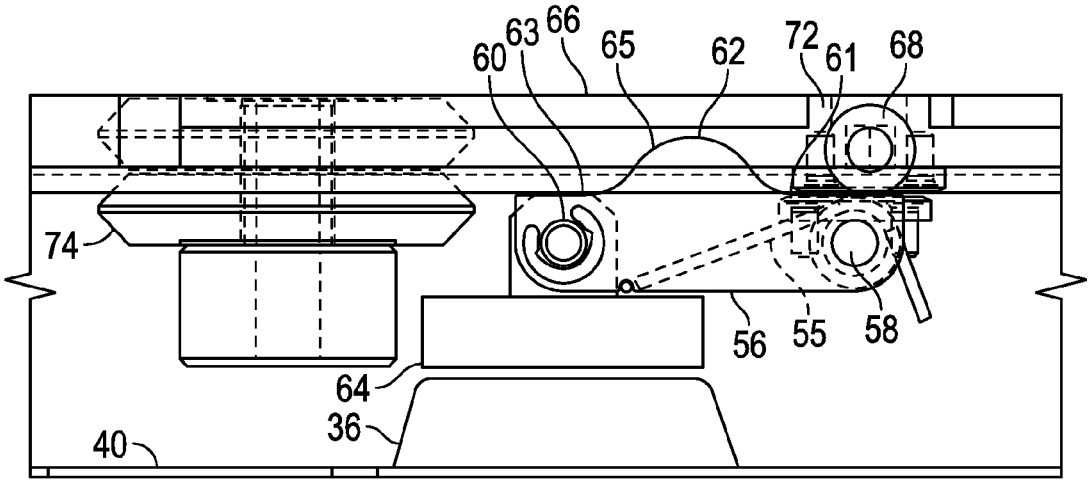
FIG. 3B is a partial, cross-sectional side view of the articulated blister actuator platen assembly in the initial unactuated state.

As shown in FIGS. 3A and 3B, the actuator platen assembly 52 includes a chassis 54. A cam body 56 is disposed within a slot 57 of the chassis 54 and is attached to the chassis 54 by a first pivot 58. A platen 64 is pivotally attached to the cam body 56 by means of a second pivot 60. The cam body 56 is held in a horizontal, unactuated position within the slot 57 by means of a torsional spring 55 coupled around the first pivot 58.

Cam body 56 further includes a cam surface 65 along one edge thereof (top edge in the figure) which, in the exemplary embodiment shown in FIG. 3B, comprises an initial flat portion 61, a convexly-curved portion 62, and a second flat portion 63. The sliding actuator plate 66 includes a cam follow 68 (a roller in the illustrated embodiment) rotatably mounted within a slot 72 formed in the actuator plate 66. In an embodiment of the invention, one cam body 56 and associated platen 64 and cam follower 68 are associated with each deformable vessel (e.g. blister 36) of the liquid reagent module 40.

The actuator platen assembly 52 and the sliding actuator plate 66 are configured to be movable relative to each other. In one embodiment, the actuator platen assembly 52 is fixed, and the actuator plate 66 is configured to move laterally relative to the platen assembly 52, supported by the V-rollers 74. Lateral movement of the sliding actuator plate 66, e.g., in the direction "A", causes the cam follower 68 to translate along the cam surface 65 of the cam body 56, thereby actuating the cam body 56 and the platen 64 attached thereto.

Figure 4A:
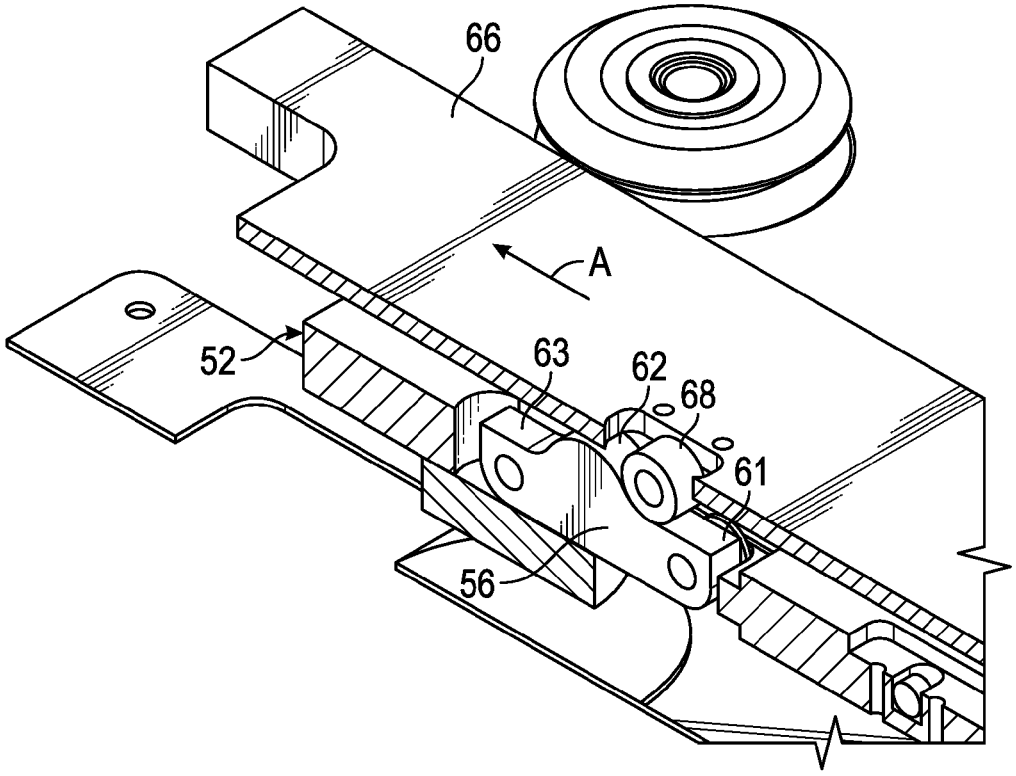
FIG. 4A is a partial, cross-sectional perspective view of the articulated blister actuator platen assembly as the platen is about to be actuated.
Figure 4B:
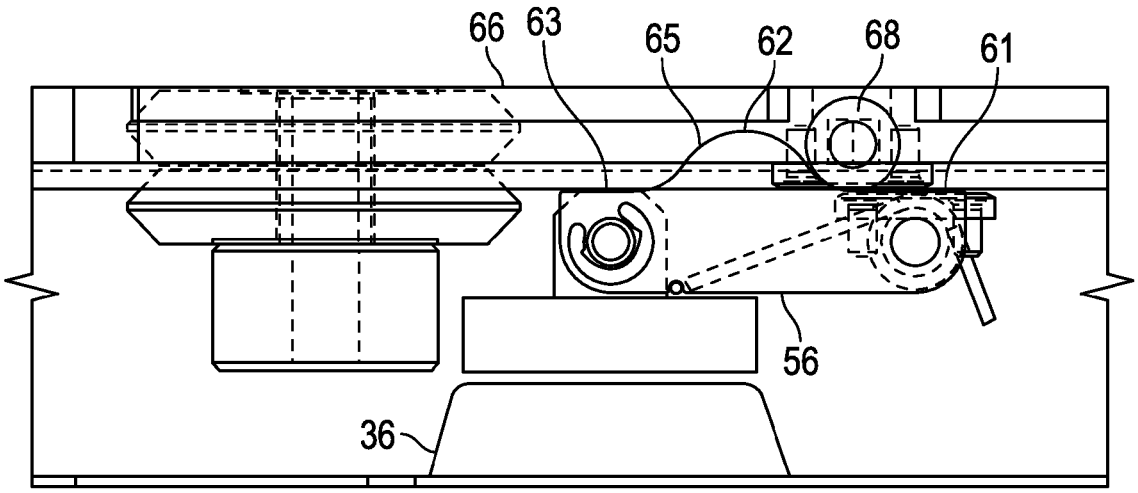
FIG. 4B is a partial, cross-sectional side view of the articulated blister actuator platen assembly as the platen is about to be actuated.

In FIGS. 3A and 3B, before the sliding actuator plate 66 has begun to move relative to the actuator platen assembly 52, the cam follower 68 is disposed on the initial flat portion 61 of the cam surface 65 of the cam body 56. In FIGS. 4A and 4B, the sliding actuator plate 66 has moved relative to the actuator platen assembly 52 in the direction "A" so that the cam follower 68 has moved across the initial flat portion 61 of the cam surface 65 and has just begun to engage the upwardly curved contour of the convexly-curved portion 62 of the cam surface 65 of the cam body 56.

Figure 5A:
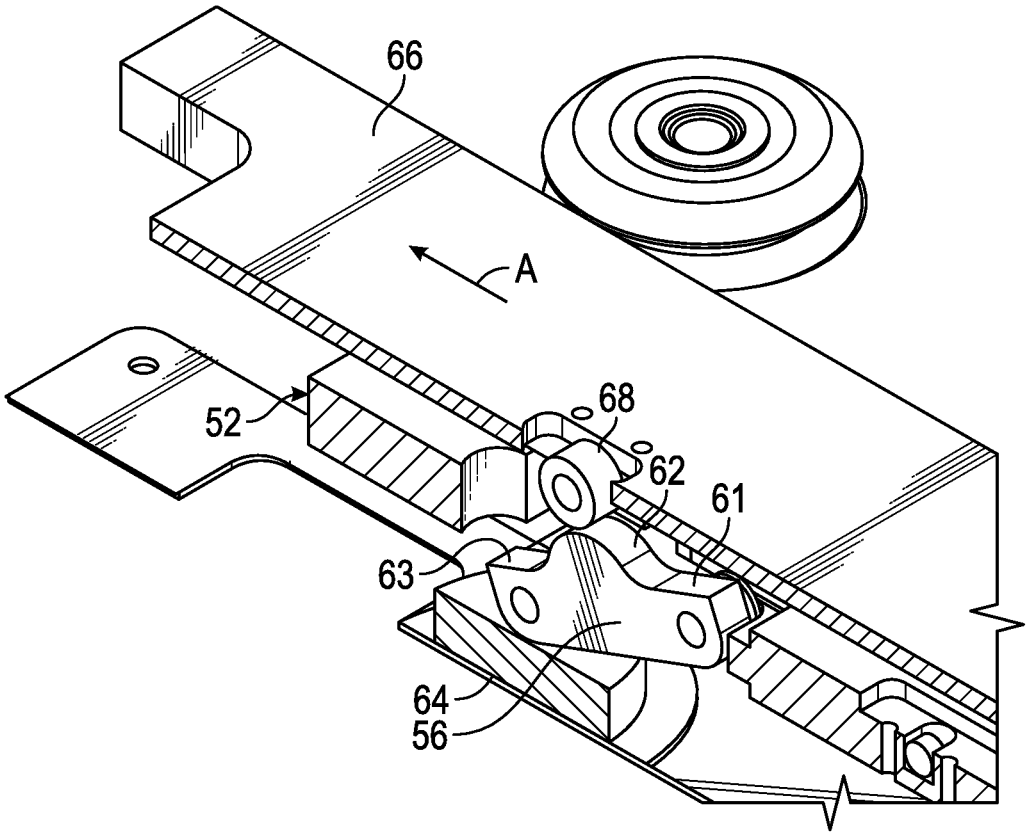
FIG. 5A is a partial, cross-sectional perspective view of the articulated blister actuator platen assembly with the platen in a fully actuated state.
Figure 5B:
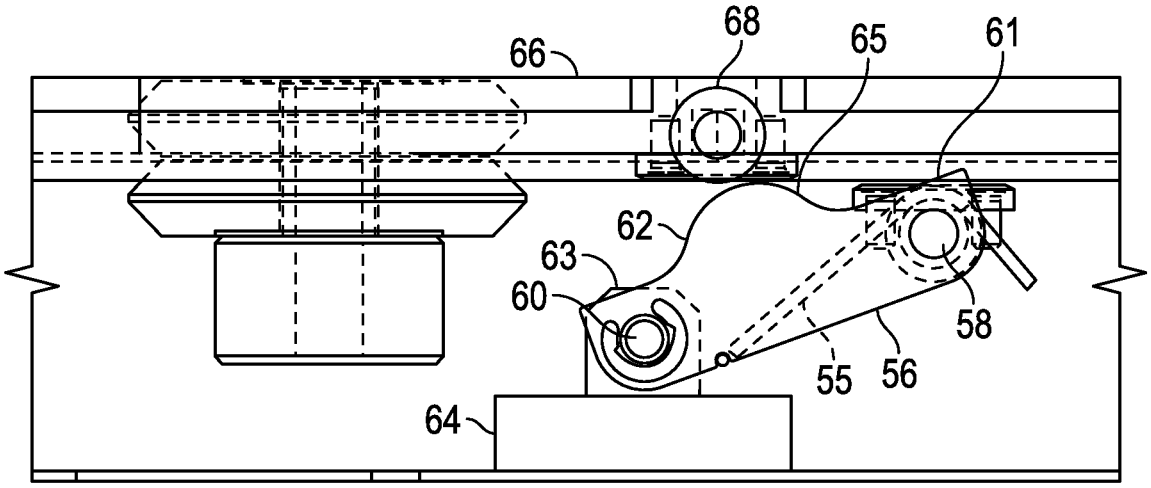
FIG. 5B is a partial, cross-sectional side view of the articulated blister actuator platen assembly with the platen in a fully actuated state.

In FIGS. 5A and 5B, the sliding actuator plate 66 has proceeded in the direction "A" to a point such that the cam follower 68 is at the topmost point of the convexly-curved portion 62 of the cam surface 65, thereby causing the cam body 56 to rotate about the first pivot 58. The platen 64 is lowered by the downwardly pivoting cam body 56 and pivots relative to the cam body 56 about the second pivot 60 and thereby compresses the blister 36.

Figure 6A:
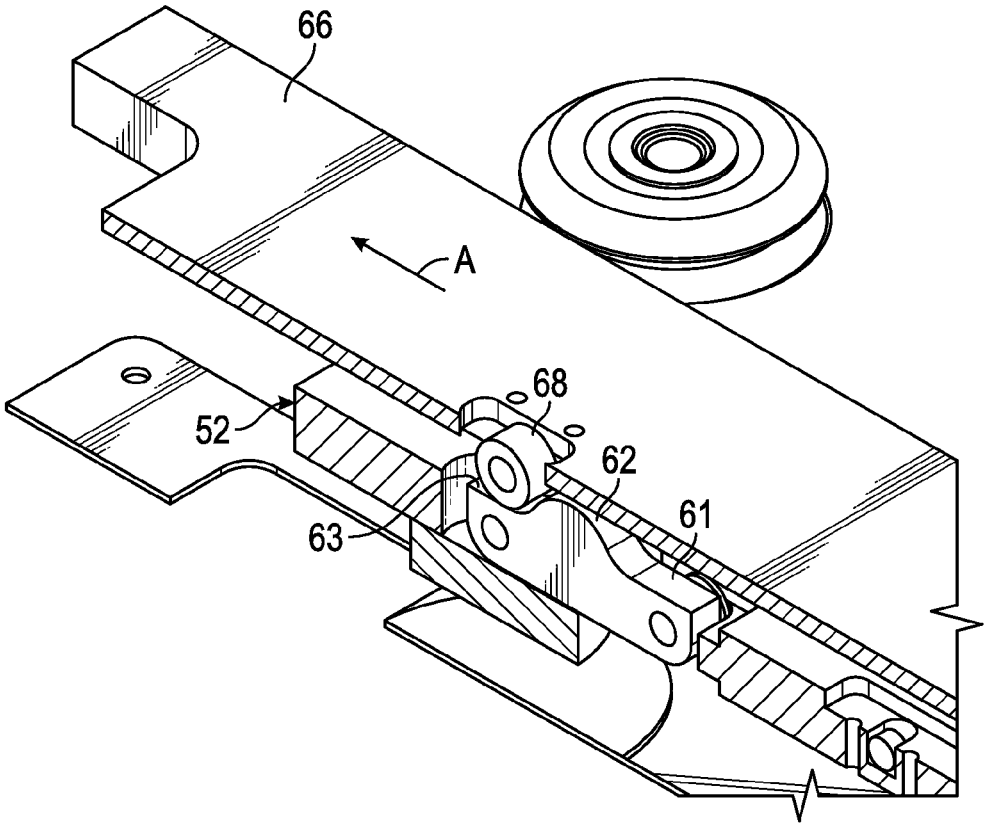
FIG. 6A is a partial, cross-sectional perspective view of the articulated blister actuator platen assembly with the platen returned to the unactuated state.
Figure 6B:
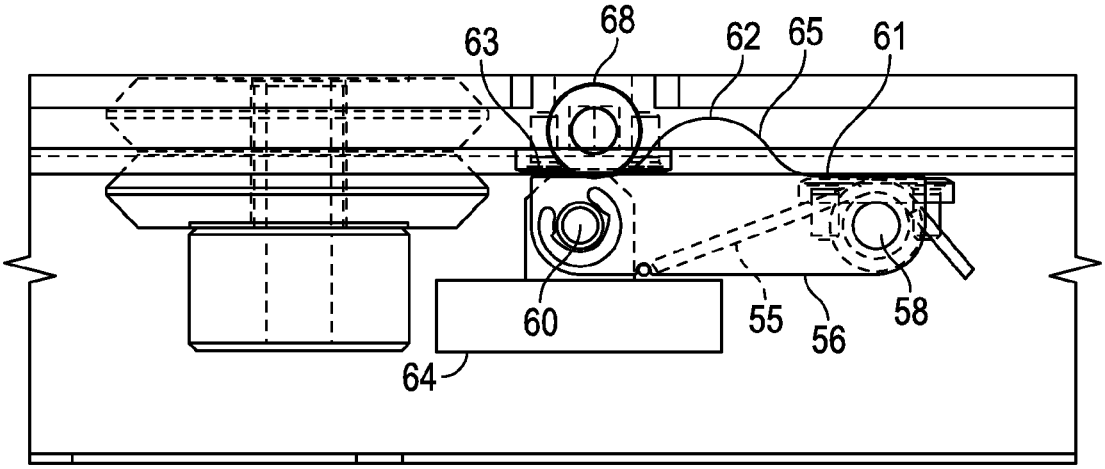
FIG. 6B is a partial, cross-sectional side view of the articulated blister actuator platen assembly with the platen returned to the unactuated state.

In FIGS. 6A and 6B, sliding actuator plate 66 has moved to a position in the direction "A" relative to the actuator platen assembly 52 such that the cam follower 68 has progressed to the second flat portion 63 of the cam surface 65. Accordingly, the cam body 56, urged by the torsion spring 55, pivots about the first pivot 58 back to the unactuated position, thereby retracting the platen 64.

Thus, the articulated blister actuator platen assembly 52 is constructed and arranged to convert the horizontal movement of actuator plate 66 into vertical movement of the platen 64 to compress a blister, and movement of the platen does not require pneumatic, electromechanical, or other components at larger distances above and/or below the liquid module.

Figure 7A:
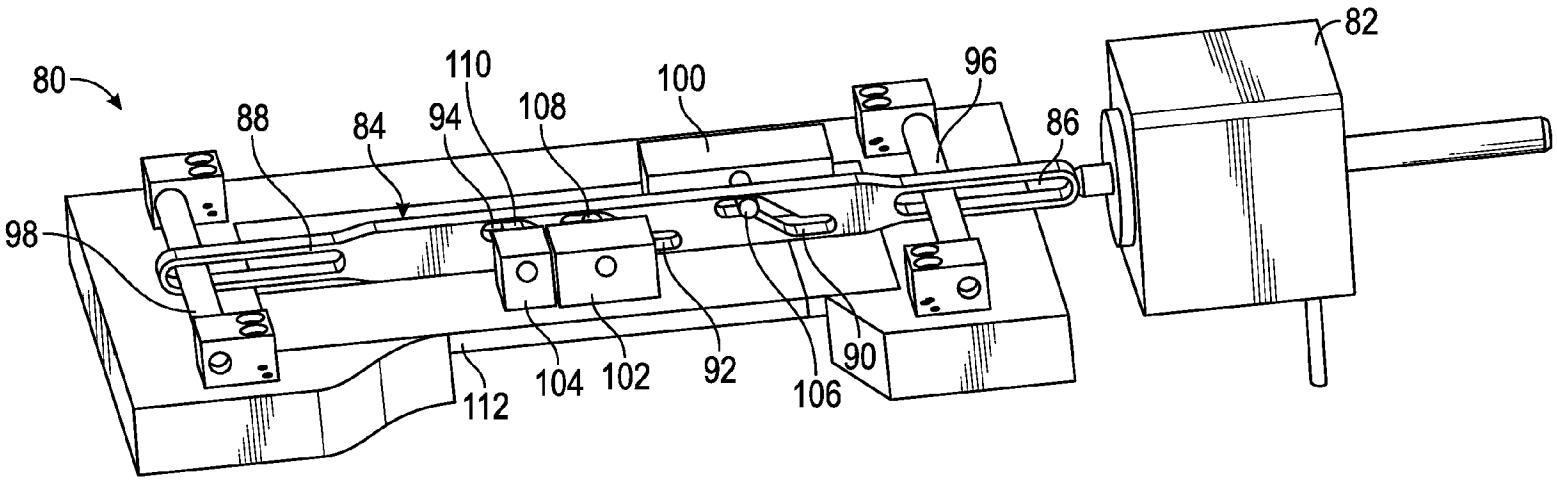
FIG. 7A is a perspective view of an alternative embodiment of a blister compressing actuator mechanism in an unactuated state.
Figure 7B:
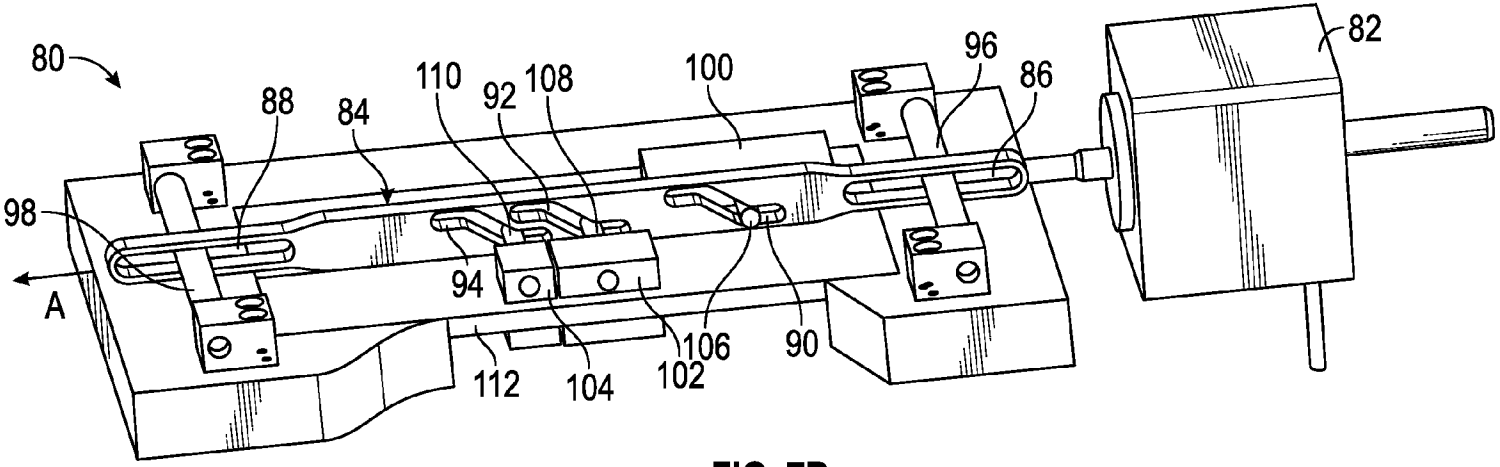
FIG. 7B is a perspective view of the blister compressing actuator mechanism of FIG. 7A in the fully actuated state.

An alternative embodiment of a blister compression actuator mechanism is indicated by reference number 80 in FIGS. 7A and 7B. Actuator 80 includes a linear actuator 82 that is coupled to a cam rail 84. Cam rail 84 is supported for longitudinal movement by a first support rod 96 extending transversely through slot 86 and a second support rod 98 extending transversely through a second slot 88 formed in the cam rail 84. The first support rod 96 and/or the second support rod 98 may include an annular groove within which portions of the cam rail 84 surrounding slot 86 or slot 88 may be supported, or cylindrical spacers may be placed over the first support rod 96 and/or the second support rod 98 on opposite sides of the cam rail 84 to prevent the cam rail 84 from twisting or sliding axially along the first support rail 96 and/or the second support rail 98.

Cam rail 84 includes one or more cam profile slots. In the illustrated embodiment, cam rail 84 includes three cam profile slots 90, 92, and 94. Referring to cam profile slot 90, in the illustrated embodiment, slot 90 includes, progressing from left to right in the figure, an initial horizontal portion, a downwardly sloped portion, and a second horizontal portion. The shapes of the cam profile slots are exemplary, and other shapes may be effectively implemented. The actuator mechanism 80 also includes a platen associated with each cam profile slot. In the illustrated embodiment, actuator 80 includes three platens 100, 102, 104 associated with cam profile slots 90, 92, 94, respectively. First platen 100 is coupled to the cam profile slot 90 by a cam follower pin 106 extending transversely from the platen 100 into the cam profile slot 90. Similarly, second platen 102 is coupled to the second cam profile slot 92 by a cam follower pin 108, and the third platen 104 is coupled to the third cam profile slot 94 by a cam follower pin 110. Platens 100, 102, 104 are supported and guided by a guide 112, which may comprise a panel having openings formed therein conforming to the shape of each of the platens.

In FIG. 7A, cam rail 84 is in its furthest right-most position, and the platens 100, 102, 104 are in their unactuated positions. Each of the cam follower pins 106, 108, 110 is in the initial upper horizontal portion of the respective cam profile slot 90, 92, 94. As the cam rail 84 is moved longitudinally to the left, in the direction "A" shown in FIG. 7B, by the linear actuator 82, each cam follower pin 106, 108, 110 moves within its respective cam profile slot 90, 92, 94 until the cam follower pin is in the lower, second horizontal portion of the respective cam profile slot. Movement of each of the pins 106, 108, 110 downwardly within its respective cam profile slot 90, 92, 94 causes a corresponding downward movement of the associated platen 100, 102, 104. This movement of the platens thereby compresses a fluid vessel (or blister) located under each platen. Each platen may compress a vessel directly in contact with the platen or it may contact the vessel through one or more intermediate components located between the vessel and the corresponding platen.

Thus, the blister compression actuator mechanism 80 is constructed and arranged to convert the horizontal movement cam rail 84, driven by the linear actuator 82, into vertical movement of the platens 100, 102, 104 to compress blisters, and movement of the platens does not require pneumatic, electromechanical, or other components at larger distances above and/or below the liquid module.

Figure 11:
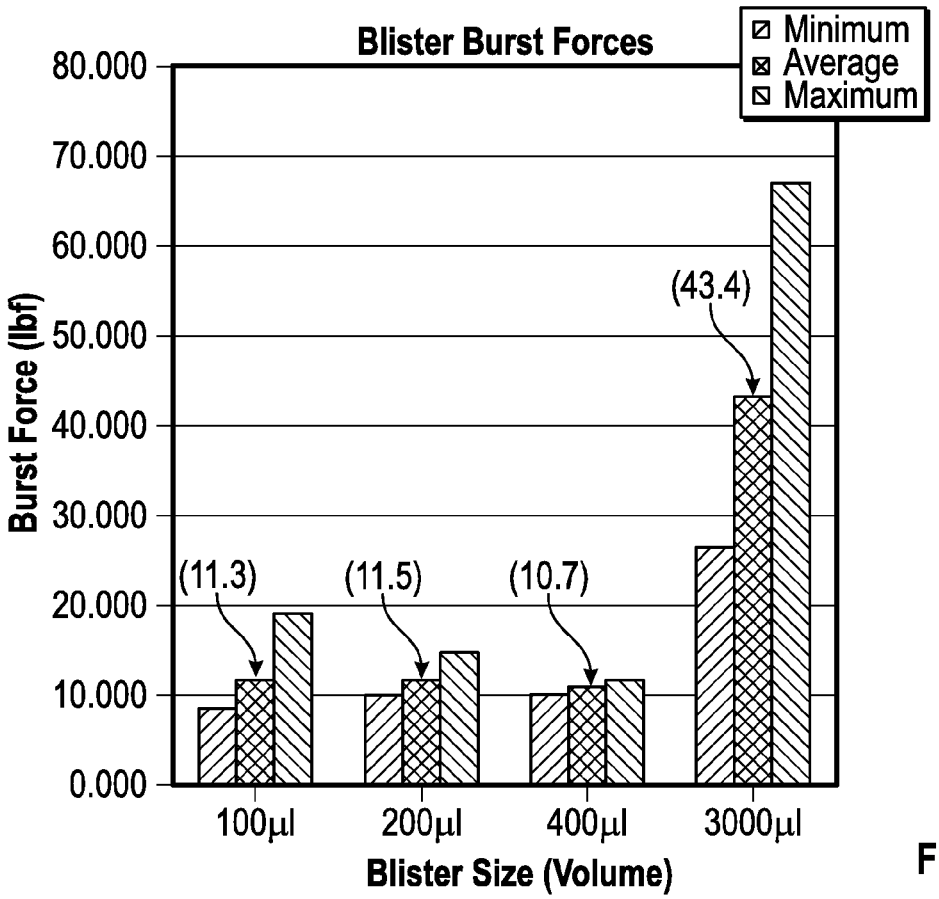
FIG. 11 is a bar graph showing exemplary burst forces for fluid-containing blisters of varying volumes.

When compressing a fluid vessel, or blister, to displace the fluid contents thereof, sufficient compressive force must be applied to the blister to break, or otherwise open, a breakable seal that is holding the fluid within the vessel. The amount of force required to break the seal and displace the fluid contents of a vessel typically increases as the volume of the vessel increases. This is illustrated in the bar graph shown in FIG. 11, which shows the minimum, maximum, and average blister burst forces required for blisters having volumes of 100, 200, 400, and 3000 microliters. The average force required to burst a blister of 400 or less microliters is relatively small, ranging from an average of 10.7 lbf to 11.5 lbf. On the other hand, the force required to burst a blister of 3000 microliters is substantially larger, with an average burst force of 43.4 lbf and a maximum required burst force of greater than 65 lbf. Generating such large forces can be difficult, especially in low profile actuator mechanisms, such as those described above, in which horizontal displacement of an actuator is converted into vertical, blister-compressing movement of a platen.

Accordingly, aspects of the present invention are embodied in methods and apparatus for opening a fluid vessel, or blister, in a manner that reduces the amount of force required to burst the vessel and displace the fluid contents of the vessel.

Figure 8A:
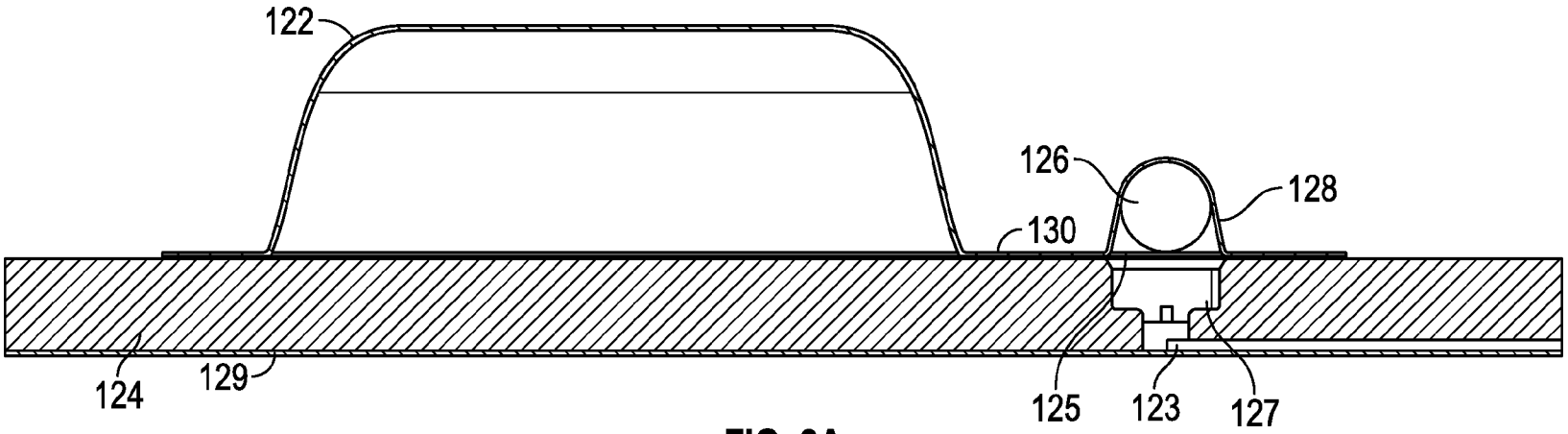
FIG. 8A is a partial, cross-sectional side view of a collapsible fluid vessel configured to facilitate opening of the vessel.
Figure 8B:
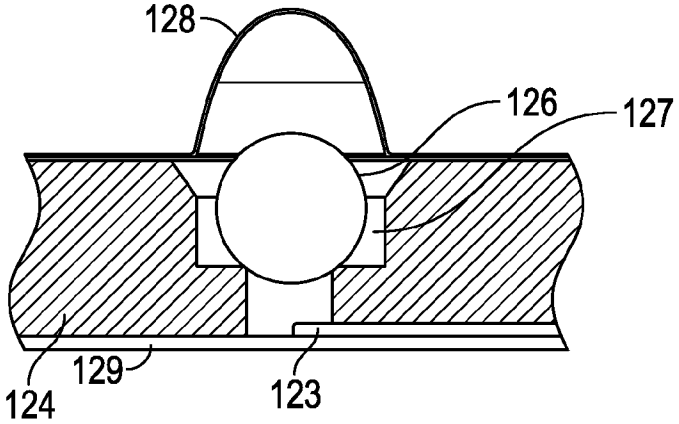
FIG. 8B is an enlarged partial, cross-sectional side view of a vessel opening feature of the collapsible fluid vessel.

Such aspects of the invention are illustrated in FIGS. 8A and 8B. As shown in FIG. 8A, a fluid vessel (or blister) 122 is mounted on a substrate 124 and is connected by means of a channel 130 to a sphere blister 128. In certain embodiments, channel 130 may be initially blocked by a breakable seal. A film layer 129 may be disposed on the bottom of the substrate 124 to cover one or more channels formed in the bottom of the substrate 124 to form fluid conduits. An opening device, comprising a sphere 126 (e.g., a steel ball bearing) is enclosed within the sphere blister 128 and is supported, as shown in FIG. 8A, within the sphere blister 128 by a foil partition or septum 125. The foil partition 125 prevents fluid from flowing from the vessel 122 through a recess 127 and fluid exit port 123. Upon applying downward force to the sphere 126, however, a large local compressive stress is generated due to the relatively small surface size of the sphere 126, and the foil partition 125 can be broken with relatively little force to push the sphere 126 through the partition 125 and into the recess 127, as shown in FIG. 8B. With the foil partition 125 broken, a relatively small additional force is required to break a seal within channel 130 and force the fluid to flow from the vessel 122 through the fluid exit port 123.

In FIG. 8B, the sphere blister 128 is shown intact. In some embodiments, a force applied to the sphere 126 to push it through the foil partition 125 would also collapse the sphere blister 128.

An apparatus for opening a vessel by pushing a sphere 126 through foil partition 125 is indicated by reference number 120 in FIGS. 9A, 9B, 9C, 9D. In the illustrated embodiment, the apparatus 120 includes a ball actuator 140 extending through an opening formed through a blister plate, or platen, 132. With the blister plate 132 and an actuator 138 configured for moving the blister plate 132 disposed above the vessel 122, the ball actuator 140 is secured in a first position, shown in FIG. 9A, by a detent 136 that engages a detent collar 144 formed in the ball actuator 140.

Figure 9A:
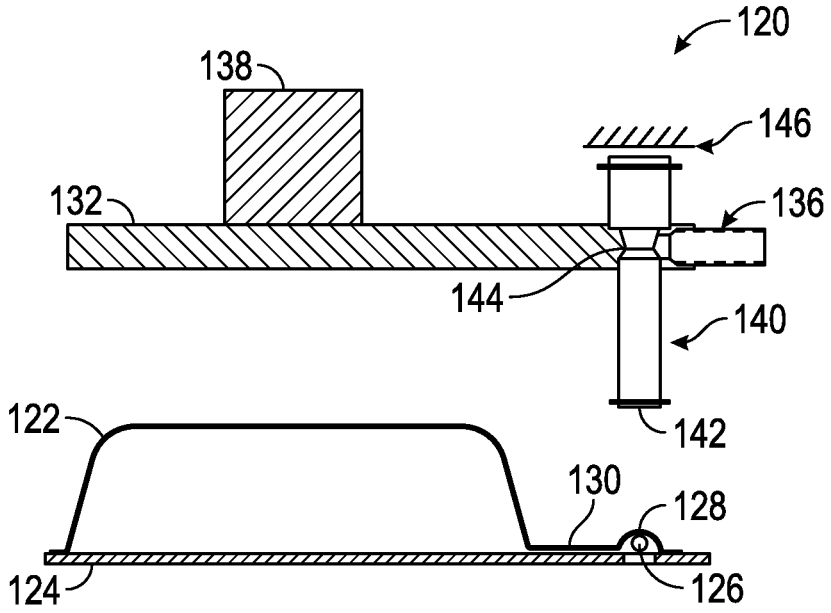
FIGS. 9A-9D are side views showing an apparatus for opening a collapsible vessel configured to facilitate opening of the vessel in various states.
Figure 9B:
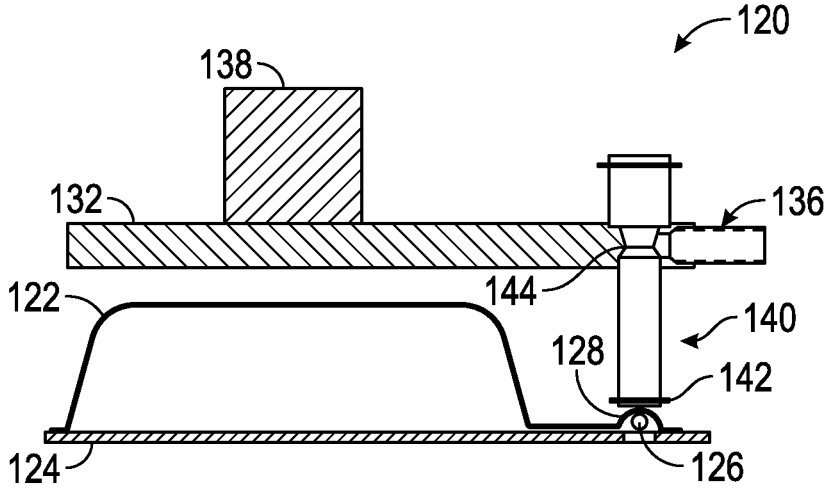

As shown in FIG. 9B, the blister plate 132 is moved by the actuator 138 down to a position in which a contact end 142 of the ball actuator 140 contacts the top of the of the sphere blister 128. Actuator 138 may comprise a low profile actuator, such as actuator mechanisms 50 or 80 described above.

Figure 9C:
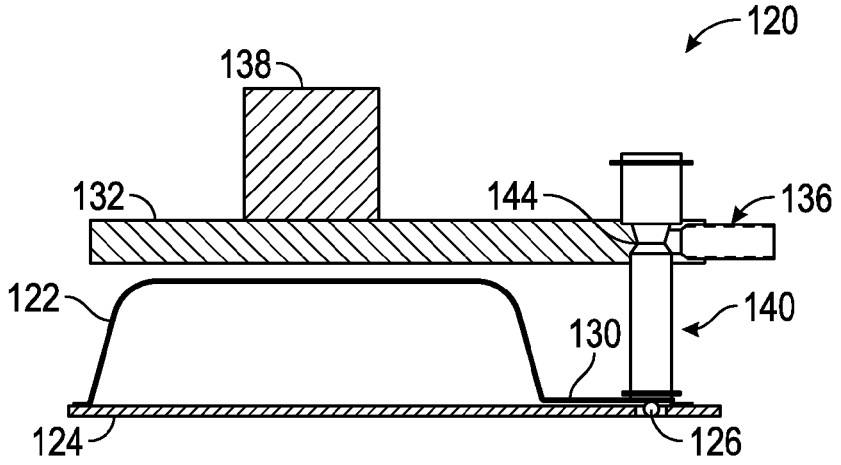

As shown in FIG. 9C, continued downward movement of the blister plate 132 by the actuator 138 causes the ball actuator 140 to collapse the sphere blister 128, thereby pushing the opening device, e.g., sphere 126, through a partition blocking fluid flow from the vessel 122. In this regard, it will be appreciated that the detent must provide a holding force sufficient to prevent the ball actuator 140 from sliding relative to the blister plate 132 until after the sphere 126 has pierced the partition. Thus, the detent must provide a holding force sufficient to collapse the sphere blister 128 and push the sphere 126 through a partition.

Figure 9D:
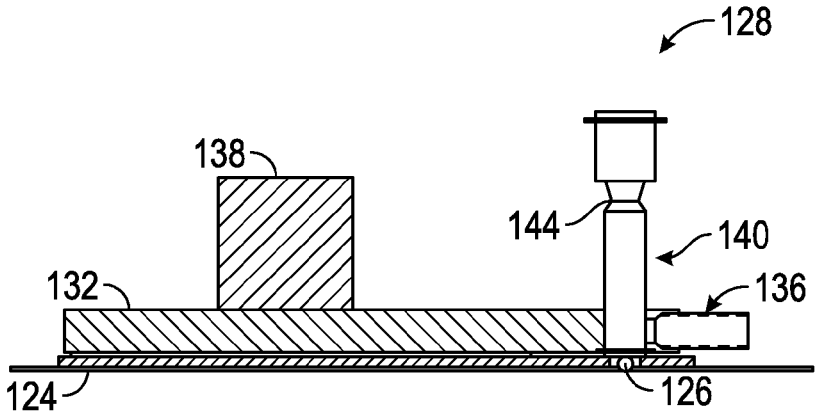

As shown in FIG. 9D, continued downward movement of the blister plate 132 by the actuator 138 eventually overcomes the holding force provided by the detent 136, and the ball actuator 140 is then released to move relative to the blister plate 132, so that the blister plate can continue to move down and collapse the vessel 122.

After the vessel 122 is collapsed, the blister plate 132 can be raised by the actuator 138 to the position shown in FIG. 9A. As the blister plate 132 is being raised from the position shown in FIG. 9D to the position shown in 9A, a hard stop 146 contacts a top end of the ball actuator 140 to prevent its continued upward movement, thereby sliding the ball actuator 140 relative to the blister plate 132 until the detent 136 contacts the detent collar 144 to reset the ball actuator 140.

Figure 10:
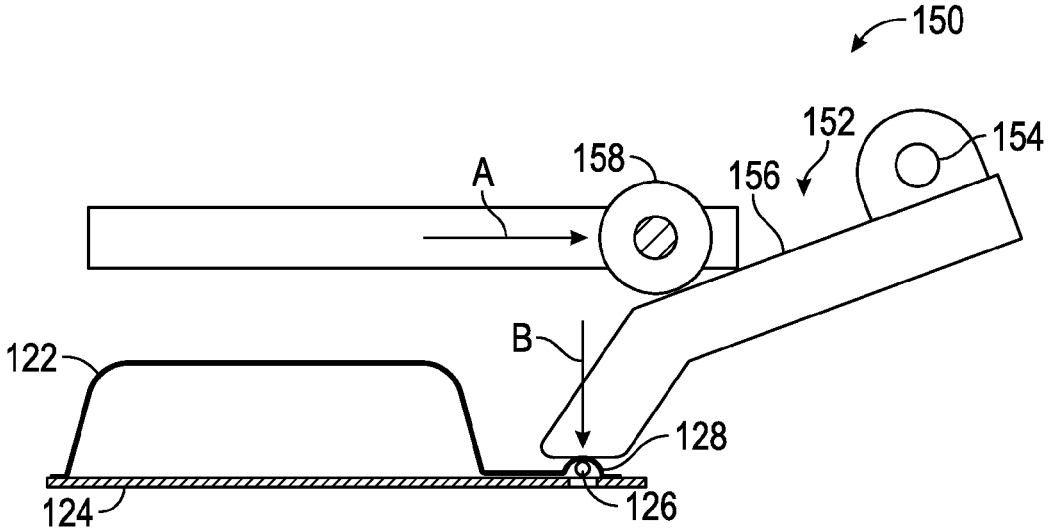
FIG. 10 is a side view of an alternative embodiment of an apparatus for opening a collapsible vessel configured to facilitate opening of the vessel.

An alternative embodiment of an apparatus for opening a vessel embodying aspects of the present invention is indicated by reference number 150 in FIG. 10. Apparatus 150 includes a pivoting ball actuator 152 configured to pivot about a pivot pin 154. A top surface 156 of the pivoting ball actuator 152 comprises a cam surface, and a cam follower 158, comprising a roller, moving in the direction "A" along the cam surface 156 pivots the actuator 152 down in the direction "B" to collapse the sphere blister 128 and force the sphere 126 through the foil partition 125. Pivoting actuator 152 may further include a torsional spring (not shown) or other means for restoring the actuator to an up position disengaged with the sphere blister 128 when the cam follower 158 is withdrawn.

Figure 12:
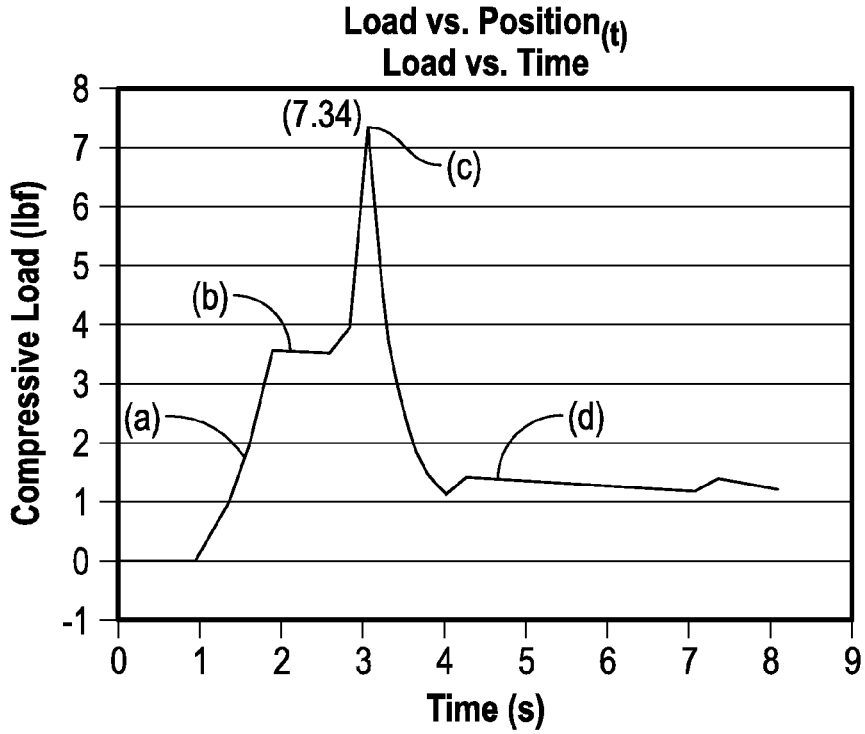
FIG. 12 is a load versus time plot of the compression load versus time during a blister compression.

FIG. 12 is a plot of compressive load versus time showing an exemplary load versus time curve for an apparatus for opening a vessel embodying aspects of the present invention. As the apparatus contacts and begins to compress the sphere blister 128, the load experiences an initial increase as shown at portion (a) of the graph. A plateau shown at portion (b) of the graph occurs after the sphere 126 penetrates the foil partition 125. A second increase in the force load occurs when the blister plate 132 makes contact with and begins compressing the vessel 122. A peak, as shown at part (c) of the plot, is reached as a breakable seal within channel 130 between the vessel 122 and the sphere blister 128 is broken. After the seal has been broken, the pressure drops dramatically, as shown at part (d) of the plot, as the vessel 122 is collapsed and the fluid contained therein is forced through the exit port 123 (See FIGS. 8A, 8B) supporting the sphere 126.

Figure 13A:
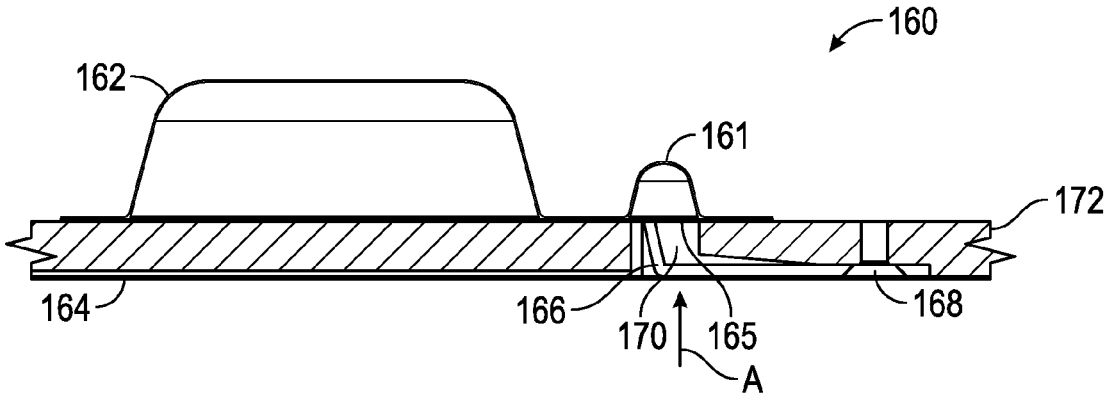
FIG. 13A is a partial, cross-sectional side view of an alternative apparatus for opening a collapsible vessel configured to facilitate opening of the vessel.
Figure 13B:
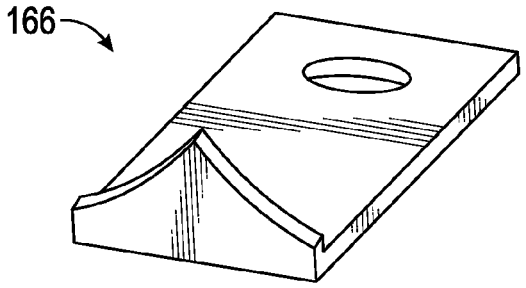

An alternative apparatus for opening a vessel is indicated by reference number 160 in FIG. 13A. As shown in FIG. 13A, a fluid vessel (or blister) 162 is mounted on a substrate 172 and is connected by means of a channel—which may or may not be initially blocked by a breakable seal—to a dimple 161. A film layer 164 may be disposed on the bottom of the substrate 172 to cover one or more channels formed in the bottom of the substrate 172 to form fluid conduits. An opening device comprising a cantilevered lance 166 is positioned within a lance chamber 170 formed in the substrate 172 where it is anchored at an end thereof by a screw attachment 168.

A foil partition or septum 165 seals the interior of the dimple 161 from the lance chamber 170. An actuator pushes the lance 170 up in the direction "A" into the dimple 161, thereby piercing the foil partition 165 and permitting fluid to flow from the blister 162 out of the lance chamber 170 and a fluid exit port. The spring force resilience of the lance 166 returns it to its initial position after the upward force is removed. In one embodiment, the lance 166 is made of metal. Alternatively, a plastic lance could be part of a molded plastic substrate on which the blister 162 is formed. Alternatively, a metallic lance could be heat staked onto a male plastic post. A further option is to employ a formed metal wire as a lance.

Figure 14:
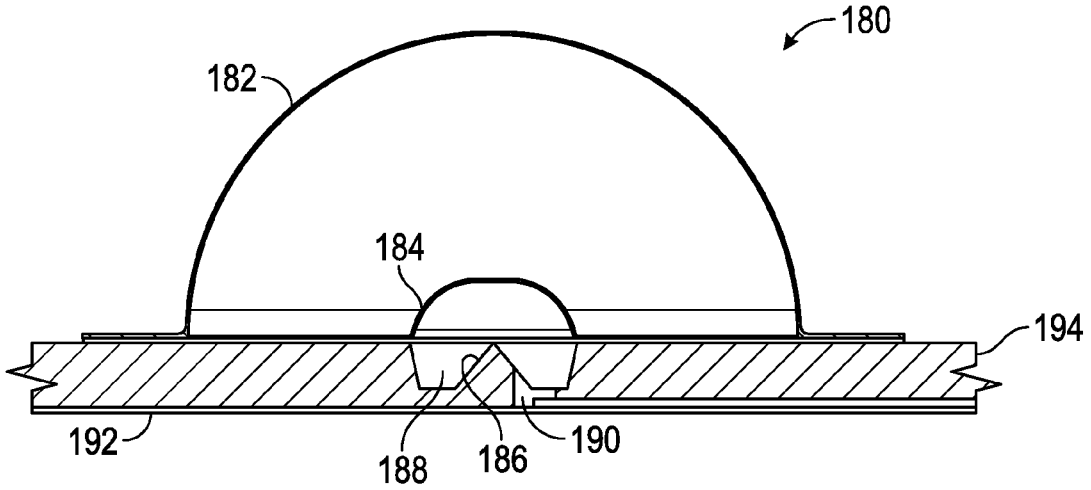
FIG. 14 is a partial, cross-sectional side view of an alternative apparatus for opening a collapsible vessel configured to facilitate opening of the vessel.

A further alternative embodiment of an apparatus for opening a vessel is indicated by reference number 180 in FIG. 14. A component having one or more deformable vessels includes at least one blister 182 formed on a substrate 194. In the arrangement shown in FIG. 14, an internal dimple 184 is formed inside the blister 182. Internal dimple 184 encloses an opening device comprising a fixed spike 186 projecting upwardly from a spike cavity 188 formed in the substrate 194. A film layer 192 is disposed on an opposite side of the substrate 194. As an actuator presses down on the blister 182, internal pressure within the blister 182 causes the internal dimple 184 to collapse and invert. The inverted dimple is punctured by the fixed spike 186, thereby permitting fluid within the blister 182 to flow through an exit port 190.

Figure 15A:
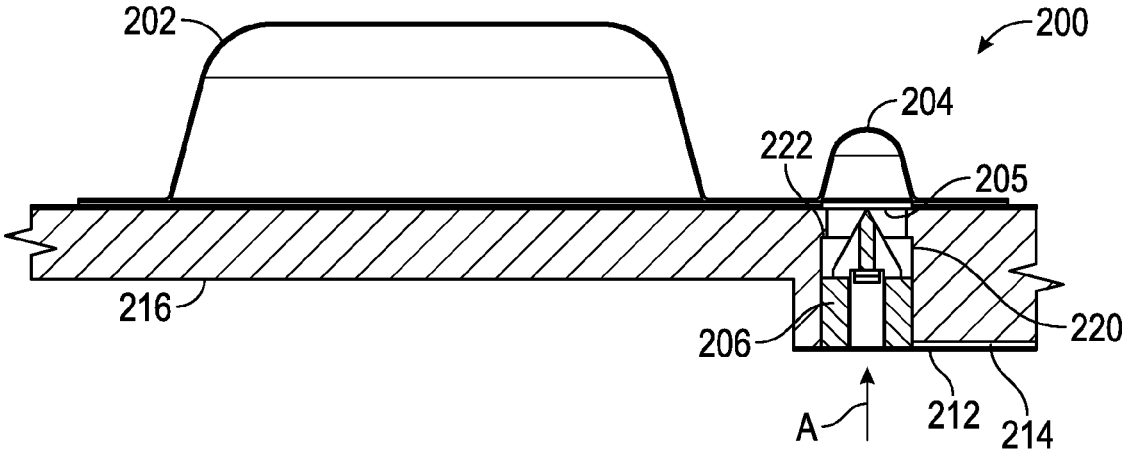
FIG. 15A is a partial, cross-sectional side view of an alternative apparatus for opening a collapsible vessel configured to facilitate opening of the vessel.
Figure 15B:
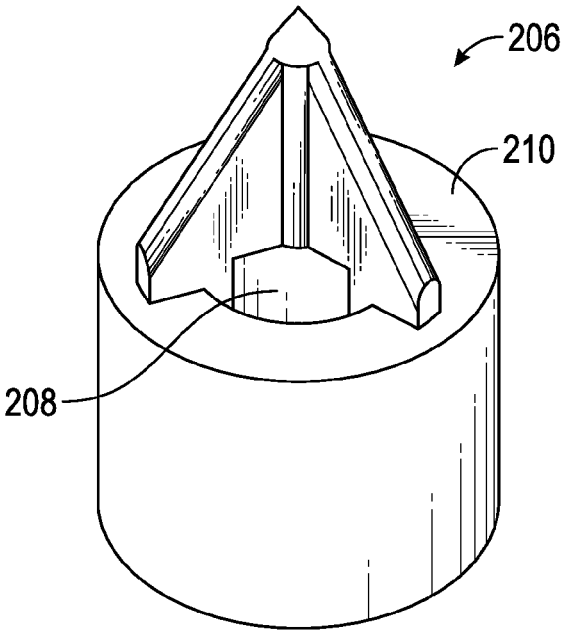
FIG. 15B is a perspective view of a lancing pin used in the apparatus of FIG. 15A.

An alternative apparatus for opening a vessel is indicated by reference number 200 in FIG. 15A. As shown in FIG. 15A, a fluid vessel (or blister) 202 is mounted on a substrate 216 and is connected by means of a channel—which may or may not be initially blocked by a breakable seal—to a dimple 204. An opening device comprising a lancing pin 206 having a fluid port 208 formed through the center thereof (see FIG. 15B) is disposed within a segmented bore 220 formed in the substrate 216 beneath the dimple 204. A partition or septum 205 separates the dimple 204 from the bore 220, thereby preventing fluid from exiting the blister 202 and dimple 204. An actuator (not shown) presses on a film layer 212 disposed on a bottom portion of the substrate 216 in the direction "A" forcing the lancing pin 206 up within the segmented bore 220 until a shoulder 210 formed on the lancing pin 206 encounters a hard stop 222 formed in the segmented bore 220. A lancing point of the pin 206 pierces the partition 205 thereby permitting fluid to flow through the fluid port 208 in the lancing pin 206 and out of a fluid exit channel 214.

Figure 16A:
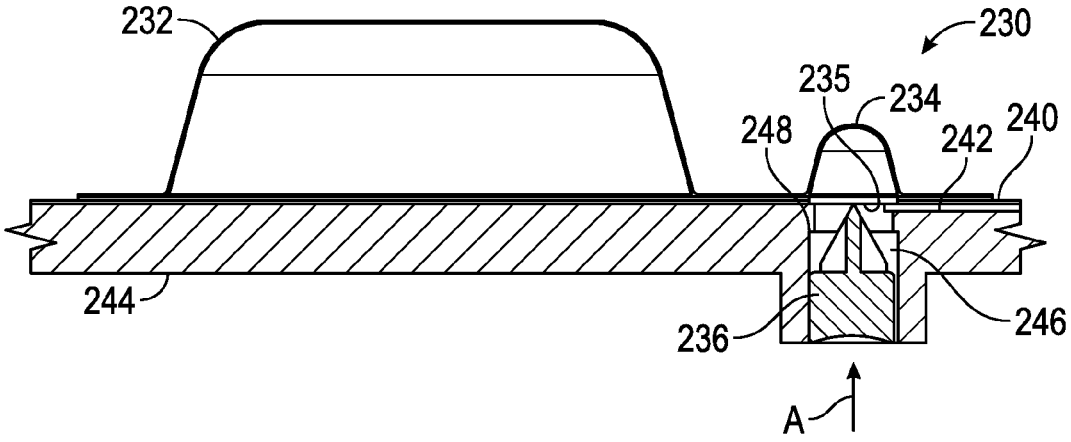
FIG. 16A is a partial, cross-sectional side view of an alternative apparatus for opening a collapsible vessel configured to facilitate opening of the vessel.
Figure 16B:
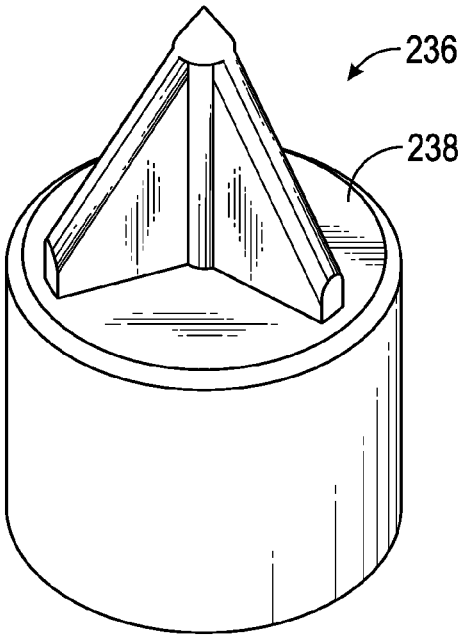
FIG. 16B is a perspective view of a lancing pin used in the apparatus of FIG. 16A.

An alternative embodiment of an apparatus for opening a vessel is indicated by reference number 230 in FIGS. 16A and 16B. As shown in FIG. 16A, a fluid vessel (or blister) 232 is mounted on a substrate 244 and is connected by means of a channel—which may or may not be initially blocked by a breakable seal—to a dimple 234. An opening device comprising a lancing pin 236 is disposed within a segmented board 246 formed in the substrate 244 beneath the dimple 234. A partition or septum 235 separates the dimple 234 from the segmented bore 246. The upper surface of the substrate 244 is sealed with a film 240 before the blister 232 and dimple 234 are adhered. An actuator (not shown) pushes up on the lancing pin 236 in the direction "A" until a shoulder 238 formed on the lancing pin 236 encounters hard stop 248 within the bore 246. The pin 236 thereby pierces the partition 235 and remains in the upper position as fluid flows out along an exit channel 242 formed on an upper surface of the substrate 244. A fluid tight seal is maintained between the pin 238 and the bore 246 by a slight interference fit.

As the collapsible fluid vessels of a liquid reagent module are configured to be compressed and collapsed to displace the fluid contents from the vessel(s), such vessels are susceptible to damage or fluid leakage due to inadvertent exposures to contacts that impart a compressing force to the vessel. Accordingly, when storing, handling, or transporting a component having one or more collapsible fluid vessels, it is desirable to protect the fluid vessel and avoid such inadvertent contact. The liquid reagent module could be stored within a rigid casing to protect the collapsible vessel(s) from unintended external forces, but such a casing would inhibit or prevent collapsing of the vessel by application of an external force. Thus, the liquid reagent module would have to be removed from the casing prior to use, thereby leaving the collapsible vessel(s) of the module vulnerable to unintended external forces.

Figure 17:
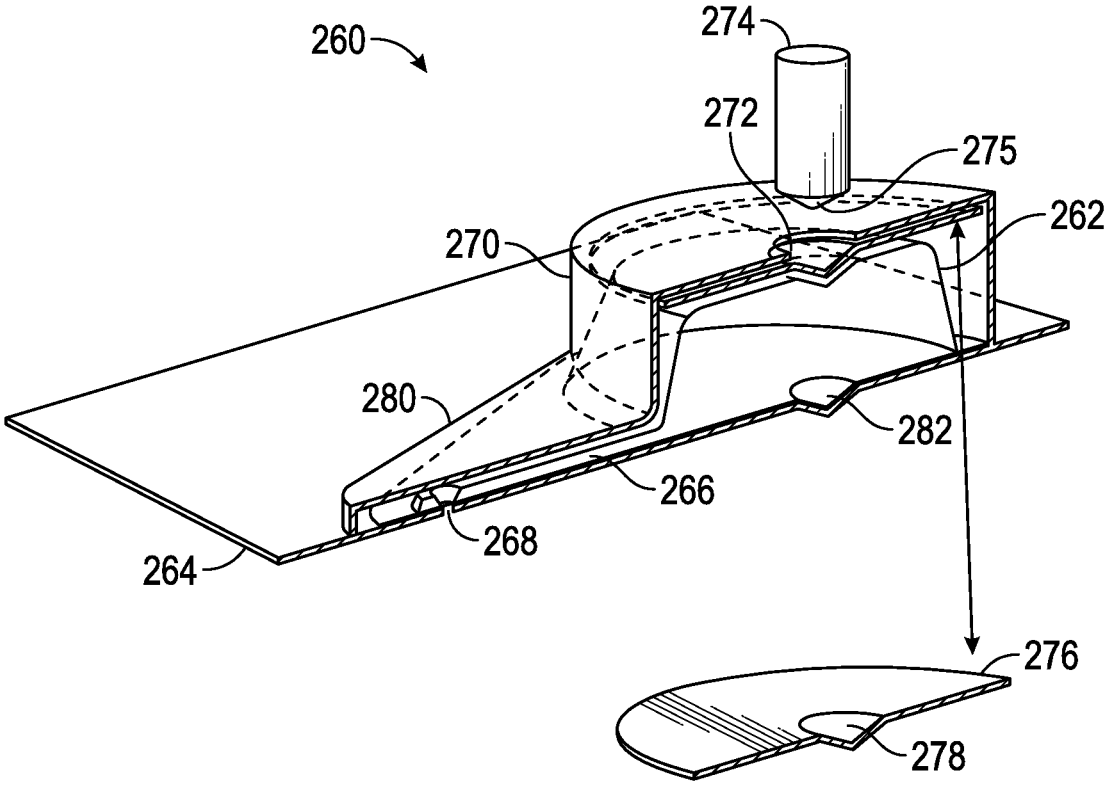
FIG. 17 is an exploded, cross-sectional, perspective view of an apparatus for protecting and interfacing with a collapsible vessel.
Figure 18:
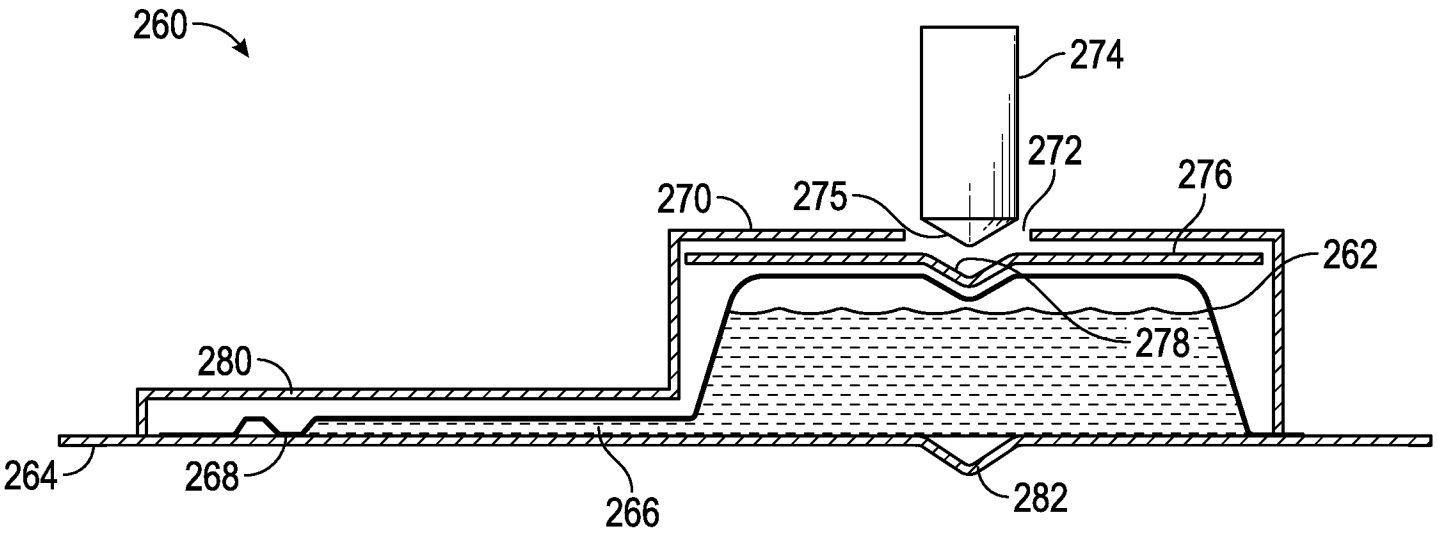
FIG. 18 is a cross-sectional, side view of the apparatus for protecting and interfacing with a collapsible vessel in an unactuated state.
Figure 19:
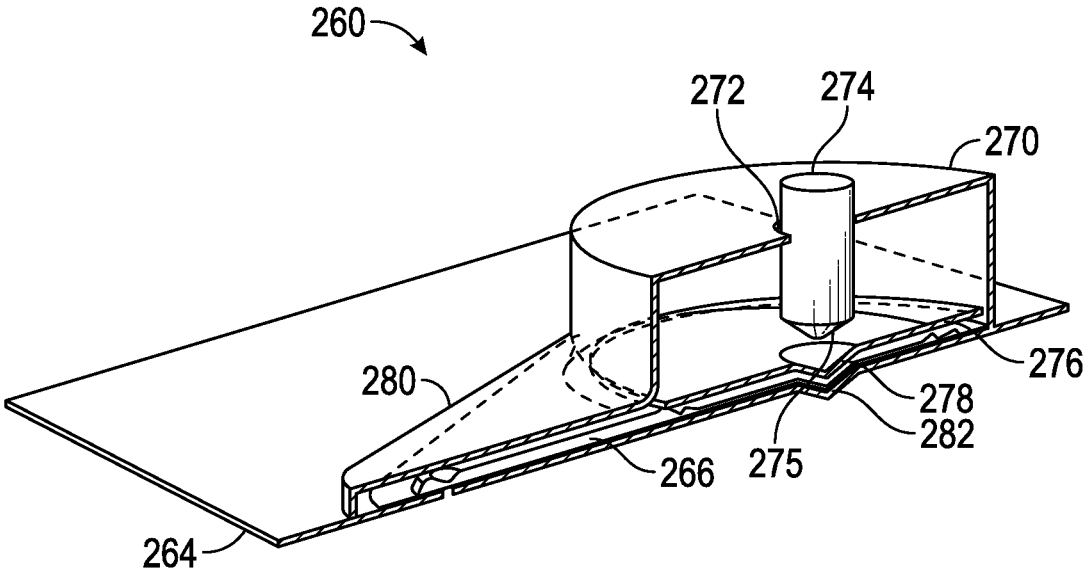
FIG. 19 is a cross-sectional, perspective view of the apparatus for protecting and interfacing with a collapsible vessel in fully actuated state.

An apparatus for protecting and interfacing with a collapsible vessel is indicated by reference number 260 in FIGS. 17, 18, and 19. A component with one or more collapsible vessels includes a collapsible blister 262 formed on a substrate 264. A dispensing channel 266 extends from the blister 262 to a frangible seal 268. It is understood that, in some alternative embodiments, the dispensing channel 266 may be substituted with a breakable seal, providing an additional safeguard against an accidental reagent release.

Frangible seal 268 may comprise one of the apparatuses for opening a vessel described above and shown in any of FIGS. 8-16.

A rigid or semi-rigid housing is provided over the blister 262 and, optionally, the dispensing channel 266 as well, and comprises a blister housing cover 270 covering the blister 262 and a blister housing extension 280 covering and protecting the dispensing channel 266 and the area of the frangible seal 268.

A floating actuator plate 276 is disposed within the blister housing cover 270. In the illustrated embodiments, both the blister housing cover 270 and the floating actuator plate 276 are circular, but the housing 270 and the actuator plate 276 could be of any shape, preferably generally conforming to the shape of the blister 262.

The apparatus 260 further includes a plunger 274 having a plunger point 275 at one end thereof. Plunger 274 is disposed above the blister housing cover 270 generally at a center portion thereof and disposed above an aperture 272 formed in the housing 270.

The floating actuator plate 276 includes a plunger receiver recess 278, which, in an embodiment, generally conforms to the shape of the plunger point 275.

The blister 262 is collapsed by actuating the plunger 274 downwardly into the aperture 272. Plunger 274 may be actuated by any suitable mechanism, including one of the actuator mechanisms 50, 80 described above. Plunger 274 passes into the aperture 272 where the plunger point 275 nests within the plunger receiver recess 278 of the floating actuator plate 276. Continued downward movement by the plunger 274 presses the actuator plate 276 against the blister 262, thereby collapsing the blister 262 and displacing fluid from the blister 262 through the dispensing channel 266 to a fluid egress. Continued pressure will cause the frangible seal at 268 to break, or an apparatus for opening the vessel as described above may be employed to open the frangible seal. The plunger point 275 nested within the plunger point recess 278 helps to keep the plunger 274 centered with respect to the actuator plate 276 and prevents the actuator plate 276 from sliding laterally relative to the plunger 274. When the blister is fully collapsed, as shown in FIG. 19, a convex side of the plunger receiver recess 278 of the floating actuator plate 276 nests within a plunger recess 282 formed in the substrate 264.

Accordingly, the blister housing cover 270 protects the blister 262 from inadvertent damage or collapse, while the floating actuator plate inside the blister housing cover 270 permits and facilitates the collapsing of the blister 262 without having to remove or otherwise alter the blister housing cover 270. In components having more than one collapsible vessel and dispensing channel, a blister housing cover may be provided for all of the vessels and dispensing channels or for some, but less than all vessels and dispensing channels.

While the present invention has been described and shown in considerable detail with reference to certain illustrative embodiments, including various combinations and sub-combinations of features, those skilled in the art will readily appreciate other embodiments and variations and modifications thereof as encompassed within the scope of the present invention. Moreover, the descriptions of such embodiments, combinations, and sub-combinations is not intended to convey that the inventions requires features or combinations of features other than those expressly recited in the claims. Accordingly, the present invention is deemed to include all modifications and variations encompassed within the spirit and scope of the following appended claims.

The invention claimed is:

1. A method for processing a fluid module including a collapsible fluid vessel containing fluid and supported on a planar substrate, said method comprising:

moving a first actuator component in a first direction that is generally parallel to the plane of the substrate while constraining the first actuator component to prevent movement of the first actuator component in a direction normal to the plane of the substrate;

coupling a second actuator component to the first actuator component to convert movement of the first actuator component in the first direction into movement of the second actuator component in a second direction that is generally normal to the plane of the substrate; and applying a force compressing the collapsible fluid vessel against the substrate with the second actuator component moving in the second direction to displace the fluid from the collapsible fluid vessel;

wherein the first actuator component comprises an actuator plate configured to be movable in the first direction, and wherein constraining the first actuator component comprises supporting the actuator plate for movement in the first direction by rollers engaged with opposed edges of the actuator plate, wherein the rollers are rotatable about axes that are perpendicular to the actuator plate.

2. The method of claim 1, wherein the second actuator component comprises a platen configured to be movable in the second direction to apply a force compressing the vessel against the substrate, and wherein coupling the second actuator component to the first actuator component comprises engaging a cam follower element of the actuator plate with a cam surface of a cam body coupled to the platen as the actuator plate moves in the first direction, thereby causing movement of the cam body that results in movement of the platen in the second direction.

3. The method of claim 2, wherein:

the cam follower element of the actuator plate comprises a roller configured to rotate about an axis of rotation that is parallel to the actuator plate and normal to the first direction; and the cam body is pivotally attached at one portion thereof to a chassis and at another portion thereof to the platen.

4. The method of claim 3, wherein the cam surface of the cam body comprises an initial flat portion and a convexly-curved portion, and movement of the roller from the initial flat portion to the convexly-curved portion causes the movement of the cam body that results in movement of the platen in the second direction.

5. A method for processing a fluid module including a collapsible fluid vessel containing fluid and supported on a planar substrate, said method comprising:

moving a first actuator component in a first direction that is generally parallel to the plane of the substrate;

using a guide to constrain the first actuator component to prevent movement of the first actuator component in a direction normal to the plane of the substrate;

coupling a second actuator component to the first actuator component to convert movement of the first actuator component in the first direction into movement of the second actuator component in a second direction that is generally normal to the plane of the substrate; and applying a force compressing the collapsible fluid vessel against the substrate with the second actuator component moving in the second direction to displace the fluid from the collapsible fluid vessel;

wherein the first actuator component comprises an actuator plate configured to be movable in the first direction, and wherein constraining the first actuator component comprises supporting the actuator plate for movement in the first direction by rollers engaged with opposed edges of the actuator plate, wherein the rollers are rotatable about axes that are perpendicular to the actuator plate.

6. The method of claim 5, wherein the second actuator component comprises a platen configured to be movable in the second direction to apply a force compressing the vessel against the substrate, and wherein coupling the second actuator component to the first actuator component comprises engaging a cam follower element of the actuator plate with a cam surface of a cam body coupled to the platen as the actuator plate moves in the first direction, thereby causing movement of the cam body that results in movement of the platen in the second direction.

7. The method of claim 6, wherein:

the cam follower element of the actuator plate comprises a roller configured to rotate about an axis of rotation that is parallel to the actuator plate and normal to the first direction; and the cam body is pivotally attached at one portion thereof to a chassis and at another portion thereof to the platen.

8. The method of claim 7, wherein the cam surface of the cam body comprises an initial flat portion and a convexly-curved portion, and movement of the roller from the initial flat portion to the convexly-curved portion causes the movement of the cam body that results in movement of the platen in the second direction.

9. A method for processing a fluid module including a collapsible vessel supported on a planar substrate, said method comprising:

moving a first actuator component in a first direction that is generally parallel to the plane of the substrate;

using a guide to constrain the first actuator component to prevent movement of the first actuator component in a direction normal to the plane of the substrate;

coupling a second actuator component to the first actuator component to convert movement of the first actuator component in the first direction into movement of the second actuator component in a second direction that is generally normal to the plane of the substrate; and applying a force compressing the vessel against the substrate with the second actuator component moving in the second direction;

wherein the first actuator component comprises an actuator plate configured to be movable in the first direction, and wherein constraining the first actuator component comprises supporting the actuator plate for movement in the first direction by rollers engaged with opposed edges of the actuator plate, wherein the rollers are rotatable about axes that are perpendicular to the actuator plate.

10. The method of claim 9, wherein the second actuator component comprises a platen configured to be movable in the second direction to apply a force compressing the vessel against the substrate, and wherein coupling the second actuator component to the first actuator component comprises engaging a cam follower element of the actuator plate with a cam surface of a cam body coupled to the platen as the actuator plate moves in the first direction, thereby causing movement of the cam body that results in movement of the platen in the second direction.

11. The method of claim 10, wherein:

the cam follower element of the actuator plate comprises a roller configured to rotate about an axis of rotation that is parallel to the actuator plate and normal to the first direction; and the cam body is pivotally attached at one portion thereof to a chassis and at another portion thereof to the platen.

12. The method of claim 11, wherein the cam surface of the cam body comprises an initial flat portion and a convexly-curved portion, and movement of the roller from the initial flat portion to the convexly-curved portion causes the movement of the cam body that results in movement of the platen in the second direction.

* * * * *